US009868001B2

(12) United States Patent
Walker et al.

(10) Patent No.: US 9,868,001 B2
(45) Date of Patent: Jan. 16, 2018

(54) RESPIRATOR FLOW CONTROL APPARATUS AND METHOD

(75) Inventors: Garry J. Walker, Stockton-on-Tees (GB); Desmond T. Curran, Durham (GB); Mark A. J. Fernandes, Warwickshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 841 days.

(21) Appl. No.: 12/680,753

(22) PCT Filed: Sep. 3, 2008

(86) PCT No.: PCT/US2008/075076

§ 371 (c)(1),
(2), (4) Date: Mar. 30, 2010

(87) PCT Pub. No.: WO2009/045674

PCT Pub. Date: Apr. 9, 2009

(65) Prior Publication Data

US 2010/0224194 A1 Sep. 9, 2010

Related U.S. Application Data

(60) Provisional application No. 60/977,699, filed on Oct. 5, 2007.

(51) Int. Cl.
*A62B 18/02* (2006.01)
*A62B 18/10* (2006.01)
(Continued)

(52) U.S. Cl.
CPC ..... *A62B 18/10* (2013.01); *A62B 18/02* (2013.01); *A62B 9/02* (2013.01); *A62B 18/003* (2013.01)

(58) Field of Classification Search
CPC .. A62B 18/10; A62B 9/02; A61B 9/02; A61B 18/003; A61B 18/02; A61B 18/025; A61B 18/10
(Continued)

(56) References Cited

U.S. PATENT DOCUMENTS 1,917,961 A 7/1933 Fee
2,048,059 A 7/1936 Giraudet de Boudemange
(Continued)

FOREIGN PATENT DOCUMENTS

DE 624224 8/1936
DE 3139198 C1 3/1983
(Continued)

OTHER PUBLICATIONS

Interior picture of Speedglass Helmet (applicants were in possession of the products shown in the pictures prior to the filing date).
(Continued)

*Primary Examiner* — Lynne Anderson

(57) ABSTRACT

An air flow control system for a respirator (10) is described which includes a shell that defines a breathable air zone for a user (18) wearing the respirator (10), an air delivery conduit (27) within the shell of the respirator, and a valve member (557) moveable relative to the air delivery conduit and within the shell to vary the air flow through the air delivery conduit. The air flow control system also includes an outer device (46) outside of the shell of the respirator that is rotatable by a user (18) of the respirator while wearing the respirator to control movement of the valve member.

17 Claims, 14 Drawing Sheets

(51) Int. Cl.
*A62B 18/00* (2006.01)
*A62B 9/02* (2006.01)

(58) Field of Classification Search
USPC ..... 128/201.19, 201.25, 201.24, 201.22, 128/201.23, 205.22, 205.25, 204.18, 128/201.222; 2/171.3, 171.4, 425, 410; 251/252, 340, 346
See application file for complete search history.

(56) References Cited

U.S. PATENT DOCUMENTS

| | | | | | |
|---|---|---|---|---|---|
| 2,882,895 | A * | 4/1959 | Galeazzi | A62B 7/04 | 128/200.29 |
| 3,129,707 | A * | 4/1964 | Becker et al. | 128/205.24 | |
| 3,223,086 | A | 12/1965 | Denton | | |
| 3,601,219 | A | 8/1971 | Raschke | | |
| 3,736,927 | A * | 6/1973 | Misaqi | A62B 18/003 | 128/201.25 |
| 3,739,774 | A * | 6/1973 | Gregory | A62B 18/04 | 128/201.28 |
| 3,777,750 | A | 12/1973 | Savornin | | |
| 3,955,570 | A | 5/1976 | Hutter | | |
| 3,961,626 | A | 6/1976 | Houchen | | |
| 3,963,021 | A | 6/1976 | Bancroft | | |
| 4,052,984 | A | 10/1977 | Brockway | | |
| 4,055,173 | A | 10/1977 | Knab | | |
| 4,116,237 | A | 9/1978 | Birch | | |
| 4,127,130 | A | 11/1978 | Naysmith | | |
| 4,172,294 | A | 10/1979 | Harris | | |
| 4,236,514 | A | 12/1980 | Moretti | | |
| 4,280,491 | A | 7/1981 | Berg | | |
| 4,293,757 | A * | 10/1981 | Niemi | A61F 9/068 | 2/8.6 |
| 4,325,366 | A * | 4/1982 | Tabor | 128/207.16 | |
| 4,403,608 | A | 9/1983 | Warncke | | |
| 4,407,280 | A | 10/1983 | Trammell et al. | | |
| 4,411,264 | A | 10/1983 | Jacobson | | |
| 4,484,575 | A | 11/1984 | Brockway et al. | | |
| 4,508,115 | A | 4/1985 | Warncke | | |
| 4,571,741 | A | 2/1986 | Guillaumot | | |
| 4,619,254 | A | 10/1986 | Moretti et al. | | |
| 4,626,122 | A | 12/1986 | Harrison et al. | | |
| 4,671,321 | A | 6/1987 | Paetzel | | |
| 4,683,880 | A * | 8/1987 | Werjefelt | 128/201.28 | |
| 4,807,614 | A * | 2/1989 | van der Smissen et al. | 128/201.23 | |
| 4,815,458 | A | 3/1989 | Sing | | |
| 4,899,740 | A | 2/1990 | Napolitano | | |
| 4,964,178 | A | 10/1990 | Giancarlo et al. | | |
| 5,003,974 | A | 4/1991 | Mou | | |
| 5,027,807 | A | 7/1991 | Wise et al. | | |
| 5,123,114 | A | 6/1992 | Desanti | | |
| 5,283,914 | A | 2/1994 | James | | |
| H1316 | H | 6/1994 | McGuiness | | |
| 5,533,500 | A | 7/1996 | Her-Mou | | |
| 5,577,495 | A | 11/1996 | Murphy | | |
| 5,592,936 | A | 1/1997 | Thomas, Jr. et al. | | |
| 5,690,095 | A | 11/1997 | Glynn et al. | | |
| 5,734,994 | A | 4/1998 | Rogers | | |
| 5,758,639 | A | 6/1998 | Ikonen | | |
| 5,819,728 | A | 10/1998 | Ritchie | | |
| 5,878,742 | A | 3/1999 | Figueredo et al. | | |
| 6,014,971 | A | 1/2000 | Danisch et al. | | |
| 6,016,802 | A * | 1/2000 | Jackson | 128/205.25 | |
| 6,032,291 | A | 3/2000 | Asenguah et al. | | |
| 6,055,666 | A | 5/2000 | Eklund et al. | | |
| 6,102,034 | A | 8/2000 | Buhlmann | | |
| 6,240,567 | B1 | 6/2001 | Johnston | | |
| 6,279,573 | B1 | 8/2001 | Johnson et al. | | |
| 6,374,823 | B1 | 4/2002 | Hajianpour | | |
| 6,615,828 | B1 | 9/2003 | Petherbridge | | |
| 6,619,286 | B2 | 9/2003 | Patel | | |
| 6,834,646 | B2 | 12/2004 | Alon et al. | | |
| 6,837,239 | B2 | 1/2005 | Beizndtsson et al. | | |
| 6,973,677 | B2 | 12/2005 | Diaz et al. | | |
| 7,051,732 | B2 | 5/2006 | Uusitalo et al. | | |
| 7,104,264 | B2 | 9/2006 | Lee et al. | | |
| 7,156,093 | B2 | 1/2007 | King | | |
| 7,200,873 | B2 * | 4/2007 | Klotz | A41D 13/1153 | 128/201.24 |
| 7,841,026 | B2 | 11/2010 | Makris | | |
| 7,975,320 | B2 * | 7/2011 | Muskovitz et al. | 2/425 | |
| 8,127,375 | B2 * | 3/2012 | Pierce | 2/425 | |
| 2003/0066121 | A1 | 4/2003 | Diaz et al. | | |
| 2003/0111074 | A1 | 6/2003 | Alon et al. | | |
| 2004/0003810 | A1 | 1/2004 | Templeton et al. | | |
| 2004/0055601 | A1 | 3/2004 | De Luca et al. | | |
| 2004/0144382 | A1 | 7/2004 | Alvey et al. | | |
| 2004/0182385 | A1 * | 9/2004 | Uusitalo et al. | 128/201.24 | |
| 2004/0187195 | A1 | 9/2004 | Wang Lee | | |
| 2004/0188743 | A1 | 9/2004 | Li et al. | | |
| 2005/0010992 | A1 | 1/2005 | Klotz et al. | | |
| 2005/0022817 | A1 | 2/2005 | Alvey | | |
| 2005/0061317 | A1 | 3/2005 | King | | |
| 2005/0199235 | A1 | 9/2005 | Borsari | | |
| 2006/0048777 | A1 | 3/2006 | Brookman | | |
| 2006/0048782 | A1 | 3/2006 | Gossweiler | | |
| 2006/0101557 | A1 | 5/2006 | Klotz | | |
| 2006/0137686 | A1 | 6/2006 | Macris | | |
| 2010/0108067 | A1 * | 5/2010 | Walker et al. | 128/205.24 | |
| 2011/0265790 | A1 * | 11/2011 | Walker et al. | 128/201.23 | |

FOREIGN PATENT DOCUMENTS

| | | | |
|---|---|---|---|
| EP | 027521 | B1 | 7/1983 |
| EP | 0325959 | A2 | 8/1989 |
| EP | 0 602 847 | | 12/1993 |
| EP | 0528733 | B1 | 9/1996 |
| EP | 127941 | | 1/2003 |
| FR | 1102541 | | 10/1955 |
| GB | 2160108 | A | 12/1985 |
| GB | 2338400 | A | 12/1999 |
| JP | 18001830 | | 2/1943 |
| JP | 53-159197 | | 5/1952 |
| JP | 47-035838 | | 9/1972 |
| JP | 48-019998 | | 6/1973 |
| JP | 59-030250 | | 2/1984 |
| JP | 59-41435 | | 3/1984 |
| JP | 63-131726 | | 8/1988 |
| JP | 63-180058 | | 11/1988 |
| JP | 4-65556 | U | 10/1990 |
| JP | 11-208261 | | 8/1999 |
| JP | 11-290472 | | 10/1999 |
| JP | 2001-170649 | | 6/2001 |
| JP | 2002-348720 | | 12/2002 |
| JP | 2003-000739 | | 1/2003 |
| JP | 2003-49317 | | 2/2003 |
| JP | 2003-119611 | | 4/2003 |
| JP | 2003-336120 | | 11/2003 |
| JP | 2004-156151 | | 6/2004 |
| JP | 2004-270087 | | 9/2004 |
| JP | 2006009181 | | 1/2006 |
| JP | 43-52448 | | 8/2009 |
| JP | 45-14909 | | 5/2010 |
| KR | 2002-0011308 | | 2/2002 |
| KR | 20-0415425 | | 5/2006 |
| KR | 20-0415988 | | 5/2006 |
| WO | WO 94/03235 | | 2/1994 |
| WO | WO 96/40370 | | 12/1996 |
| WO | WO 99/24742 | | 11/1997 |
| WO | WO 98/54991 | | 12/1998 |
| WO | WO 01/44126 | | 12/2000 |
| WO | WO 01/52675 | A2 | 7/2001 |
| WO | WO 02/13384 | | 2/2002 |
| WO | WO 2006/102545 | A2 | 9/2006 |
| WO | WO 2007/028877 | A2 | 3/2007 |
| WO | WO 2008/118770 | A1 | 10/2008 |

OTHER PUBLICATIONS

Picture of Albatross Helmet (applicants were in possession of the products shown in the pictures prior to the filing date).

(56) References Cited

OTHER PUBLICATIONS

Interior picture of Optrel Helmet (applicants were in possession of the products shown in the pictures prior to the filing date).
Solar-Powered Cooling Pith Helmet from Hammacher Schlemmer, obtained from internet on Jan. 22, 2007, http://www.hammacher.com/publish/72808.asp?source=google.

* cited by examiner

RESPIRATOR FLOW CONTROL APPARATUS AND METHOD

CROSS REFERENCE TO RELATED APPLICATIONS

This application is a national stage filing under 35 U.S.C. 371 of PCT/US2008/075076, filed Sep. 3, 2008, which claims priority to U.S. Application No. 60/977,699, filed Oct. 5, 2007, the disclosure of which is incorporated by reference in its/their entirety herein.

BACKGROUND

Generally, this disclosure relates to respirators that are worn on a user's head to provide breathable air for the user.

Respirators are well known and have many uses. For example, respirators may be used to allow the user to breathe safely in a contaminated atmosphere, such as a smoke filled atmosphere, a fire or a dust laden atmosphere, or in a mine or at high altitudes where sufficient breathable air is otherwise unavailable, or in a toxic atmosphere, or in a laboratory. Respirators may also be worn where it is desired to protect the user from contaminating the surrounding atmosphere, such as when working in a clean room used to manufacture silicone chips.

Some respirators have a helmet that is intended to provide some protection against impacts when working in a dangerous environment or when the user is at risk of being struck by falling or thrown debris such as in a mine, an industrial setting or on a construction site. Another type of respirator employs a hood when head protection from impact is not believed to be required such as, for example, when working in a laboratory or a clean room.

A respirator hood is usually made of a soft, flexible material suitable for the environment in which the hood is to be worn, and an apron or skirt may be provided at a lower end of the hood to extend over the shoulder region of the user. Hoods of this type are commonly used with a bodysuit to isolate the user from the environment in which the user is working. The apron or skirt often serves as an interface with the bodysuit to shield the user from ambient atmospheric conditions. Another form of hood is sometimes referred to as a head cover, and does not cover a user's entire head, but only extends above the ears of the user, and extends down about the chin of the user in front of the user's ears. The hood has a transparent region at the front, commonly referred to as a visor, through which the user can see. The visor may be an integral part of the hood or detachable so that it can be removed and replaced if damaged.

A respirator helmet or hood is intended to provide a breathable air zone for a user. As such, the helmet or hood is also typically sealed about the user's head and/or neck area. At least one air supply provides breathable air to the interior of the respirator helmet or hood. The air supply pipe may be connected to a remote air source separate from the user, but for many applications, the air supply pipe is connected to a portable air source carried by the user, commonly on the user's back or carried on a belt. In one form, a portable air supply comprises a turbo unit, including a fan driven by a motor powered by a battery and a filter. The portable air supply is intended to provide a breathable air supply to the user for a predetermined period of time.

SUMMARY

One embodiment of the invention is an air flow control system for a respirator which includes a shell that defines a breathable air zone for a user wearing the respirator, an air delivery conduit within the shell of the respirator, and a valve member moveable relative to the air delivery conduit and within the shell to vary the air flow through the air delivery conduit. The air flow control system also includes an outer device outside of the shell of the respirator that is rotatable by a user of the respirator while wearing the respirator to control movement of the valve member.

In one embodiment, a method for controlling air flow within a respirator includes forcing air through an air delivery conduit within a shell of the respirator, wherein the shell defines a breathable air zone for a user wearing the respirator. The method further includes rotating an outer device outside of and adjacent to the shell, by a user of the respirator while wearing the respirator, to vary the air flow through the air delivery conduit.

In yet another embodiment of the invention, an air flow control system for a respirator includes a shell that defines a breathable air zone for a user wearing the respirator, wherein the shell comprises a fabric hood, and an air delivery conduit within the shell of the respirator. The system also includes an air inlet conduit in fluid communication with the air delivery conduit, where the air inlet conduit extends out of the shell, and a valve member moveable relative to the air delivery conduit and within the shell to vary the air flow through the air delivery conduit. The system further includes an outer device outside of the shell of the respirator and configured to fit over the air delivery conduit, where the outer device is rotatable by a user of the respirator while wearing the respirator to control linear movement of the valve member. The air inlet conduit has a thread in a portion of a helical shape and is configured so that rotation of the outer device causes movement of a ridge relative to the thread and causes movement of the valve member relative to the air delivery conduit.

This Summary is provided to introduce a selection of concepts in a simplified form that are further described below in the Detailed Description. This Summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

Glossary

The terms set forth below will have the meanings as defined:

Hood means a loose fitting face piece that covers at least a face of the user but does not provide head impact protection.

Helmet means a head covering that is at least partially formed from a material that provides impact protection for a user's head and includes a face piece that covers at least a face of the user.

Non-shape stable means a characteristic of a structure whereby that structure may assume a shape, but is not necessarily able, by itself, to retain that shape without additional support.

Shape stable means a characteristic of a structure whereby that structure has a defined shape and is able to retain that shape by itself, although it may be flexible.

Breathable air zone means the space around at least a user's nose and mouth where air may be inhaled.

Shell means a barrier that separates an interior of a respirator, including at least the breathable air zone, from the ambient environment of the respirator. A hood or helmet can serve as a shell.

Removable means that a part can be connected and disconnect to another structure without causing damage to either structure. Tools may or may not be required to accomplish the connection or disconnection.

Valve means a device that regulates the flow of air.

Valve actuator means a device responsible for moving a valve member of a valve.

Valve member means an element of a valve that is moveable relative to a manifold.

Manifold means an air flow plenum having an air inlet and having one or discrete air conduits in communication with the air inlet, with each air conduit having at least one air outlet.

Figure 1:
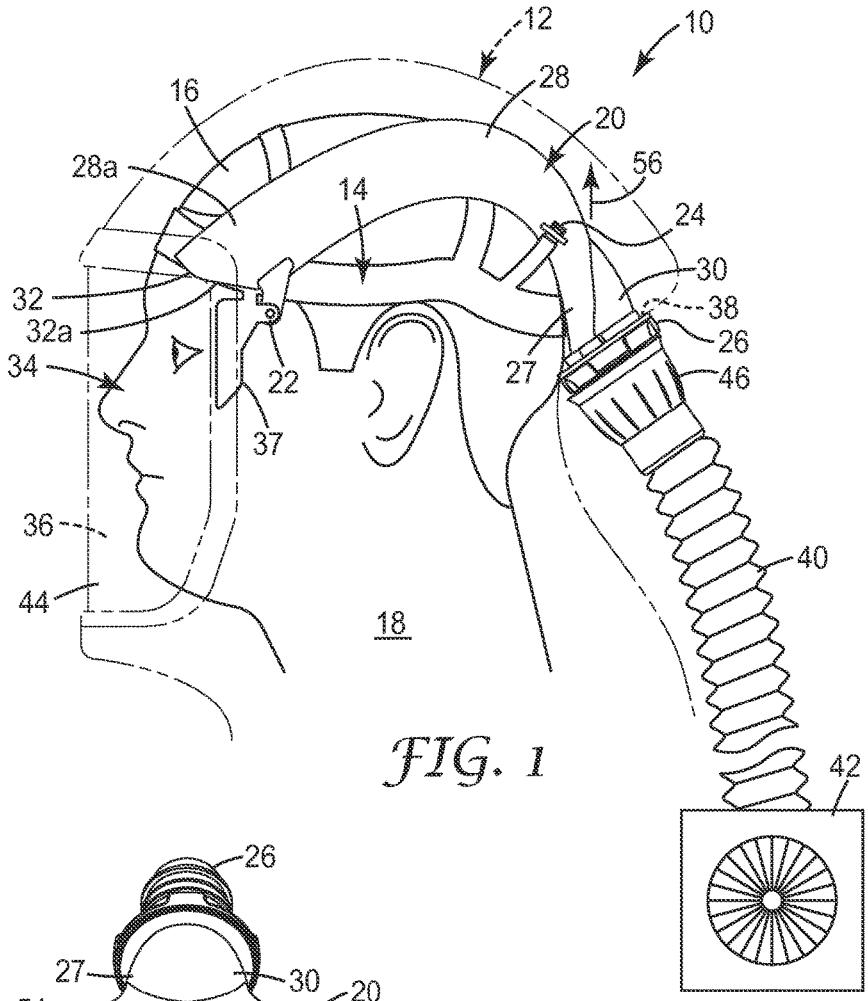
FIG. 1 is a side elevation of a respirator assembly, with a respirator shell shown in phantom.
Figure 2:
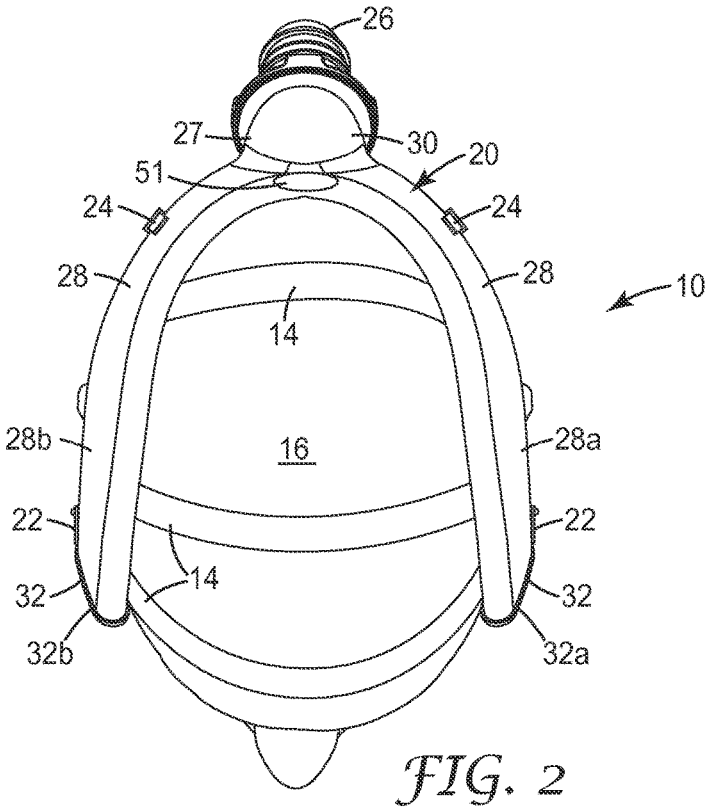
FIG. 2 is a top view of the respirator assembly of FIG. 1, with the shell removed for clarity of illustration.

A respirator assembly 10 is illustrated in FIG. 1. In this instance, the respirator assembly 10 includes a non-shape stable hood 12 that serves as a shell for the respirator assembly 10 and that, for clarity of illustration in FIG. 1, is shown by phantom lines. A top view of the respirator assembly 10 is shown in FIG. 2. The respirator assembly 10 further includes a head harness 14 that is adjustable in one or more dimensions so that it may be sized to conform to a head 16 of a user 18. The hood 12 is sized to extend over at least a front and top of the head 16 of the user 18, if not over the entire head 16.

The respirator assembly 10 further comprises a shape stable air manifold 20. The manifold 20 is removably supported by the harness 14 at a plurality of points such as attachment points 22 and 24 in FIG. 1. The harness 14 and manifold 20 are secured together by suitable mechanical fasteners, such as detents, clips, snaps, or two part mechanical fasteners (e.g., hook and loop fasteners). In one embodiment, the harness 14 and manifold 20 are separable via such fasteners. When connected and mounted on a user's head 16 as illustrated in FIG. 1, the harness 14 supports the manifold 20 in a desired position relative to the user's head 16.

As seen in FIGS. 1 and 2, the air manifold 20 has an air inlet conduit 26 and a plurality of air delivery conduits 27 and 28 (in FIG. 2, two of the delivery conduits 28*a* and 28*b* are illustrated). In one embodiment, the air inlet conduit 26 is disposed adjacent a back of the user's head 16. The air inlet conduit 26 is mostly covered by an outer device 46. The air inlet conduit 26 is in fluid communication with the air delivery conduit 27. The air delivery conduit 27 includes an air distribution chamber 30 and is in turn in fluid communication with each air delivery conduit 28. The air delivery conduit 27 and its air distribution chamber 30 are also disposed adjacent the back of the user's head 16, and as the air delivery conduits 28 extend forwardly therefrom, they curve and split to provide separate left and right conduits for the flow of air therethrough. Each air delivery conduit 28 has an air outlet 32 (e.g., air outlet 32*a* of air delivery conduit 28*a* and air outlet 32*b* of air delivery conduit 28*b*). In one embodiment, each air outlet 32*a* and 32*b* is adjacent a facial area 34 of the head 16 of the user 18. While only two air delivery conduits 28 are illustrated on the manifold 20 in FIGS. 1 and 2, it is understood that any number (e.g., one, two, three, etc.) of such conduits may be provided. Further, in some embodiments, a manifold may have one or more outlets of respective air delivery conduits adjacent a user's forehead and one or more outlets of respective air delivery conduits adjacent a user's nose and mouth (e.g., on each side of the user's nose and mouth).

Valve 51 (FIG. 2) is another air outlet located at the juncture of the left and right air delivery conduits. Air flow from valve 51 travels up the back of the user's head, as illustrated by arrow 56 in FIG. 1.

The hood 12 includes a visor 36 disposed on a front side thereof through which a user 18 can see. In one embodiment, (see, e.g., FIG. 1), an interior portion of the visor 36 (or an interior portion of the hood) is releasably affixed to a tab portion 37 of the harness 14, on each side of the user's facial area 34. The hood 12 is thus supported adjacent its front side by the harness 14. On its back side, the hood 12 includes an air inlet opening 38 (FIG. 1). The air inlet conduit 26 of the manifold 20 extends through the air inlet opening 38 and is in fluid communication with a supply of breathable air via an air hose 40 attached to the air inlet conduit 26 (that attachment being, as shown in the embodiment of FIG. 1, outside of the hood 12). The hose 40 is in turn connected to a supply 42 of breathable air for the user 18. Such a supply 42 may take the form of a pressurized tank of breathable air, a powered air-purifying respirator (PAPR) or a supplied breathable air source, as is known. The air flows from the supply 42 through hose 40 and into the air inlet conduit 26 of the manifold 20. The air then flows through the air distribution chamber 30 of the air delivery conduit 27 and into each of the air delivery conduits 28. Air flows out of each conduit 28 from its air outlet 32 and into a breathable air zone 44 defined by the hood 12 about the head 16 of the user 18. Breathable air is thus delivered by the manifold 20 to the user's facial area 34 for inhalation purposes which, in some embodiments, includes not only the space around the user's nose and mouth where air may be inhaled, but also other areas about the user's face such as around the user's eyes and forehead.

Because of the introduction of such air, the air pressure within the hood 12 typically may be slightly greater than the air pressure outside the hood. Thus, the hood 12 can expand generally to the shape illustrated in FIG. 1 about the user's head 16, manifold 20 and harness 14. As is typical, air is allowed to escape the hood 12 via exhalation ports (not shown) or via allowed leakage adjacent the lower edges of the hood 12 (e.g., about the neck and/or shoulders of the user 18). The respirator assembly 10 thus provides the user 18 with a breathable zone of air 44 within the non-shape stable hood 12, with the air delivered adjacent the user's face by the shape stable manifold 20.

Figure 3:
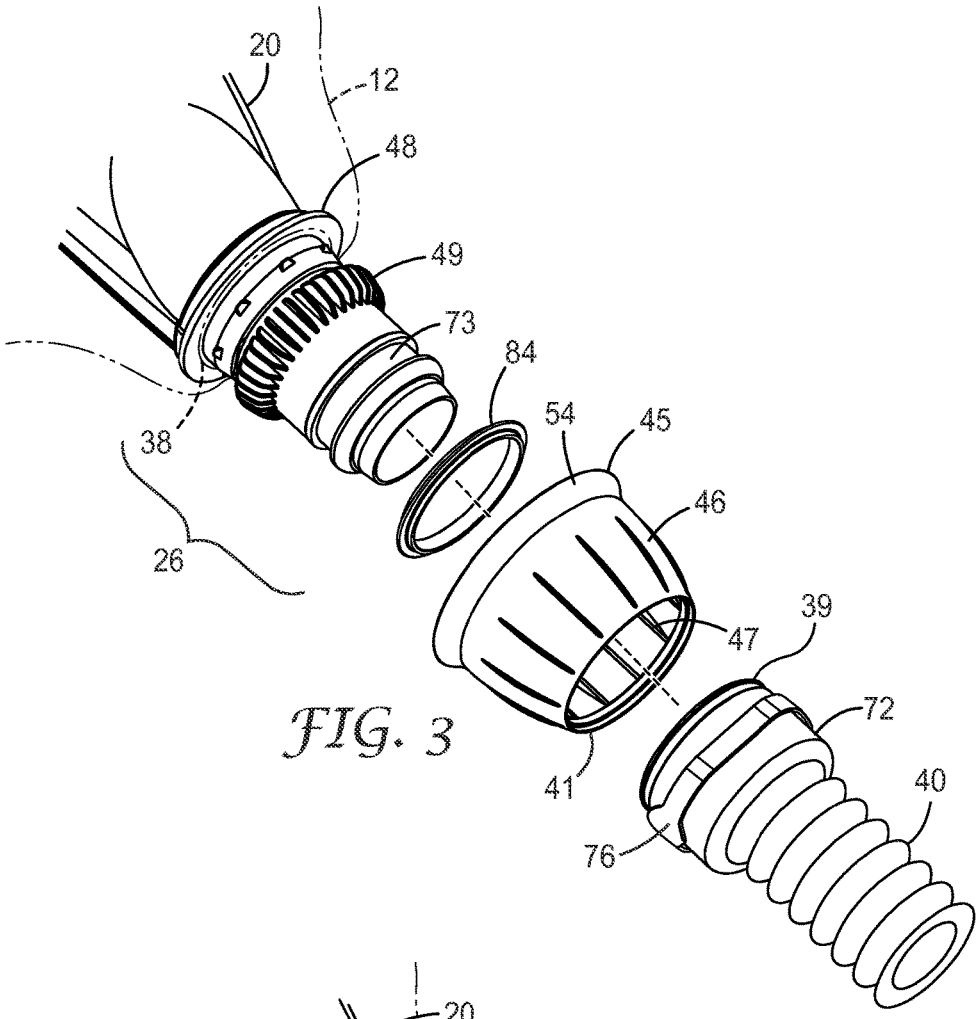
FIG. 3 is a partially exploded perspective view of the manifold for a respirator assembly, with a respirator shell shown in phantom over a shoulder of the air inlet conduit.
Figure 4:
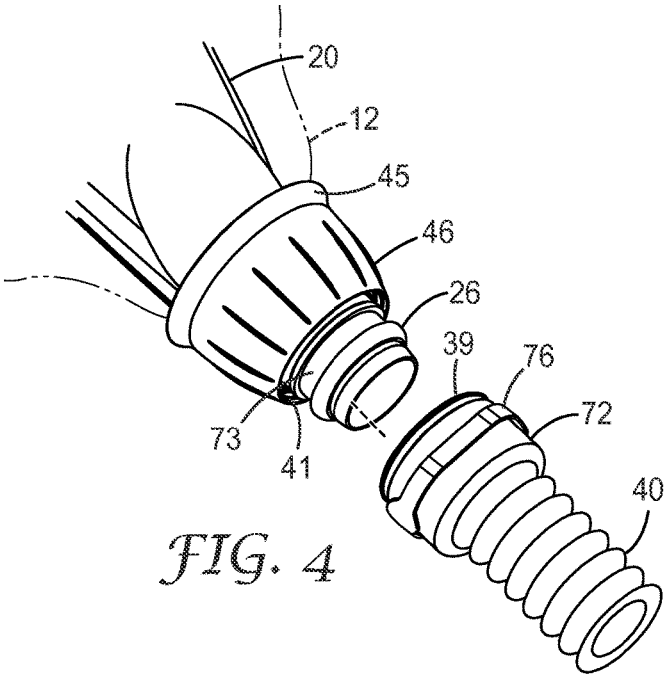
FIG. 4 is an enlarged perspective view of the assembled manifold with a respirator shell shown in phantom.
Figure 5:
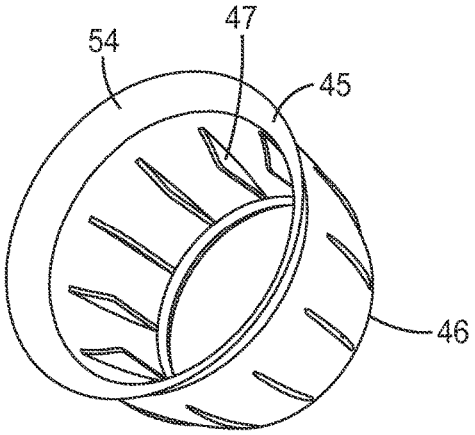
FIG. 5 is a perspective view of an outer device of the respirator assembly from its end.

FIGS. 3 and 4 illustrate a connection between the hood 12 and the manifold 20 via the air inlet opening 38 of the hood 12. The hood 12 is shown in phantom lines for clarity of illustration. The air inlet conduit 26 extends through the air inlet opening 38 of the hood 12. An outer device 46 is received on the air inlet conduit 26 on an external side of the hood 12. The outer device 46 is shown positioned near the air inlet conduit 26 in FIG. 3 and shown positioned on the air inlet conduit in FIG. 4. FIG. 5 is a perspective view of the outer device 46 from the end 45 closest to the manifold 20 in FIG. 3. As seen in FIGS. 3 and 5, the outer device 46 has structures 47 on its interior surface which engage cooperative structures 49 on the air inlet conduit 26. The hood material adjacent the air inlet opening 38 is urged against an annular shoulder 48 of the air inlet conduit 26 by a lip 54 of the outer device 46. Lip 54 of the outer device and shoulder 48 thus cooperate to form a seal between the hood 12 and manifold 20 where the manifold 20 passes through the air inlet opening 38 of the hood 12.

In some embodiments, a gasket 84 is positioned between the annular shoulder 48 and the outer device 46 to improve the seal. The gasket may either be positioned over the hood or under the hood to enhance the seal. In one configuration, the gasket 84 is positioned around the top of the air inlet conduit 26, abutting the annular shoulder 48, during assembly of the air inlet conduit. The user may remove and replace the gasket if it becomes worn by sliding it over the end of the air inlet conduit. In some embodiments, a gasket is integral with either the outer device 46 or the annular shoulder 48. For example, in some embodiments, the gasket is bonded to the outer device or annular shoulder, or integrally formed with the outer device or annular shoulder, such as in a molding process.

In the embodiment illustrated in FIGS. 3-5, the structures 47 of the outer device 46 are fins or ridges that extend along the interior cavity of the outer device 46. The cooperative structures 49 of the air inlet conduit are also fins or ridges that are configured to fit between the structures 47.

In alternative embodiments, mating structures different than structures 47 and 49 are used. For example, the outer device 46 and air inlet conduit 26 are formed as interlocking square structures in one embodiment, where the outer surface of the air inlet conduit has four equal sides, and the inner surface of the outer device 46 has four equal sides. Shaped forms of other geometries possible also. For example, another embodiment of the outer device and air inlet conduit will be described herein with respect to FIGS. 16-21.

The outer device is positioned on the air inlet conduit in a manner that traps hood material between them. In each instance, the outer device 46 is removable from the air inlet conduit. The hood 12 is removable with respect to the manifold 20 (and harness 14 attached thereto of FIGS. 1 and 2). Thus, the hood 12 may be considered a disposable portion of the respirator assembly 10. Once used, soiled or contaminated by use, the hood 12 may be disconnected via separation of the hood 12 from the manifold 20 by means of removal of the outer device 46, and by disconnection of the hood 12 from the harness 14, if so attached. The hood may be discarded, and a new hood 12 attached to the harness 14 and to the manifold 20 for reuse.

When a user attaches a hood 12 to a manifold 20, the user first inserts the air inlet conduit 26 into the opening 38 of the hood 12, as shown in FIG. 3. The hood will cover the annular shoulder 48. In some embodiments, the user positions gasket 84 against the hood material on annular shoulder 48, or under the hood material on the annular shoulder.

In some embodiments, the gasket 84 is already in place on the air inlet conduit when it is provided to the user. Then the user places the outer device 46 over the air inlet conduit 26 and pushes the outer device 46 toward the manifold 20, as shown in FIG. 4. Now the outer device is locking and sealing the fabric of the hood 12 against the air inlet conduit. Next a hose 40 is attached to the end of the air inlet conduit.

The hose 40 includes a hose connector 72, which attaches to the air inlet conduit. In some embodiments, the hose connector 72 includes a squeezable band 76 that fits within a groove 73 at the end of the air inlet conduit 26 and allows the rotation of the hose 38 with respect to the air inlet conduit 26. One example of a useful hose connector 72 having such a squeezable band 76 is the hose connector commercially available from 3M Company of St. Paul, Minn. as a QRS breathing hose.

In the embodiment of FIGS. 3 and 4, the hose 40 and hose connector 72 are attached to the groove 73 of the air inlet conduit 26 in a separate step from, though after, the outer device is placed on the air inlet conduit 26. A ridge 39 on the end of the hose connector 72 is received in a groove 41 on the end of the outer device 46. In some embodiments however, the outer device 46 and hose connector 72 are permanently or semi-permanently connected to each other, so that the user can place the outer device 46 over the air inlet conduit 26 and attach the hose connector 72 to the groove 73 in one motion. An example of this type of structure will be further discussed herein.

By separating the structure facilitating the air flow within the hood from the hood itself, the hood construction is simplified and less expensive. In addition, in some embodiments, no portion of the air flow conduits are formed from non-shape stable material (i.e., from hood material) and thus prone to collapse, which can lead to inconsistent air flow to a user or to inappropriate air flow distribution (such as the air blowing directly into the user's eyes). The shape stable manifold 20 has a defined configuration that does not appreciably change, even though the shape of the hood may be altered by contact with certain objects. Thus, the conduits for air delivery defined by the manifold 20 will not collapse or be redirected inadvertently to provide an undesired direction of air flow into the breathable air zone.

In embodiments where a shape stable material is used for the manifold, the manifold 20 is formed (i.e., molded) from a thermoplastic polymer material such as, for example, polypropylene, polyethylene, polythene, nylon/epdm mixture and expanded polyurethane foam. Such materials might incorporate fillers or additives such as pigments, hollow glass, microspheres, fibers, etc.

The cost of fabricating the harness and manifold assembly will typically be greater than the cost of fabricating the hood alone. Thus, the more expensive components (e.g., harness and manifold) are reusable, while a used hood can be removed therefrom and a new hood can be substituted in its place. Indeed, the reusable manifold 20 may be used with hoods of different configurations, so long as each hood is provided with an air inlet opening sized and positioned to sealably mate with the air inlet conduit of the manifold. A hood formed as a portion of a full body suit, a shoulder length hood, a head cover or even hoods of different styles (e.g., different visor shapes or hood shape configurations) can thus be used with the same manifold 20. The hood may be non-shape stable, as discussed above, while the manifold is shape stable, thereby insuring that the air flow to the user will be consistent in volume and consistently delivered to a desired outlet position within the breathable air zone.

Figure 6:
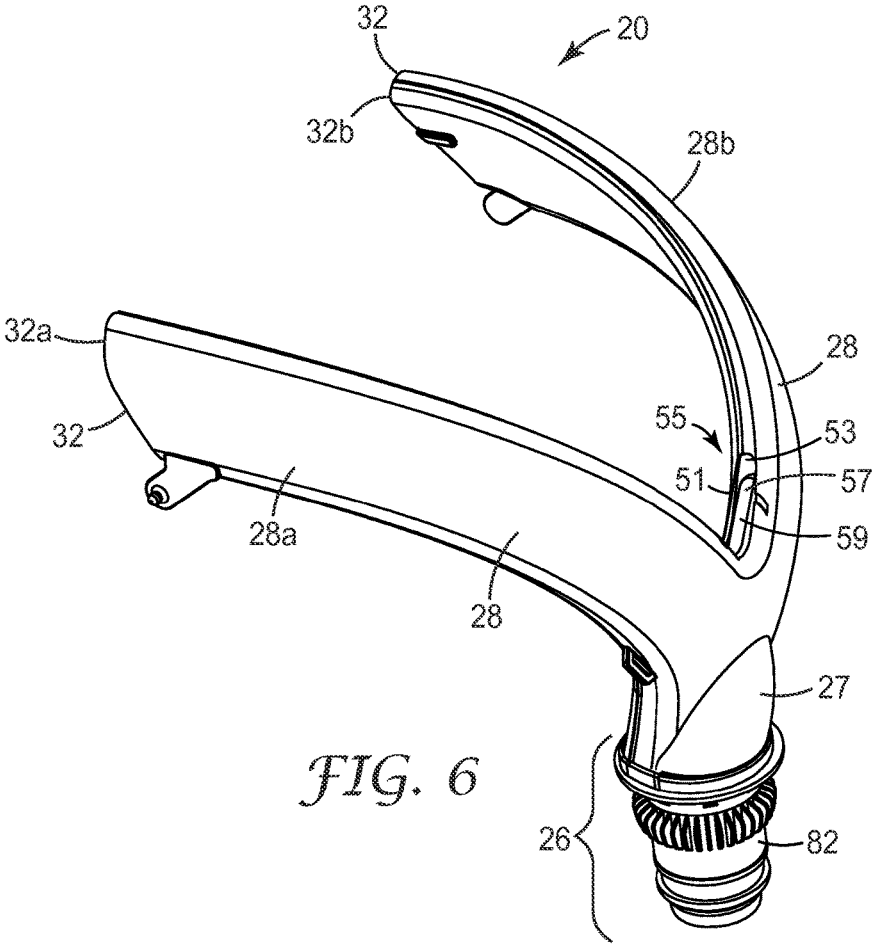
FIG. 6 is a perspective view of the manifold for a respirator assembly.
Figure 7:
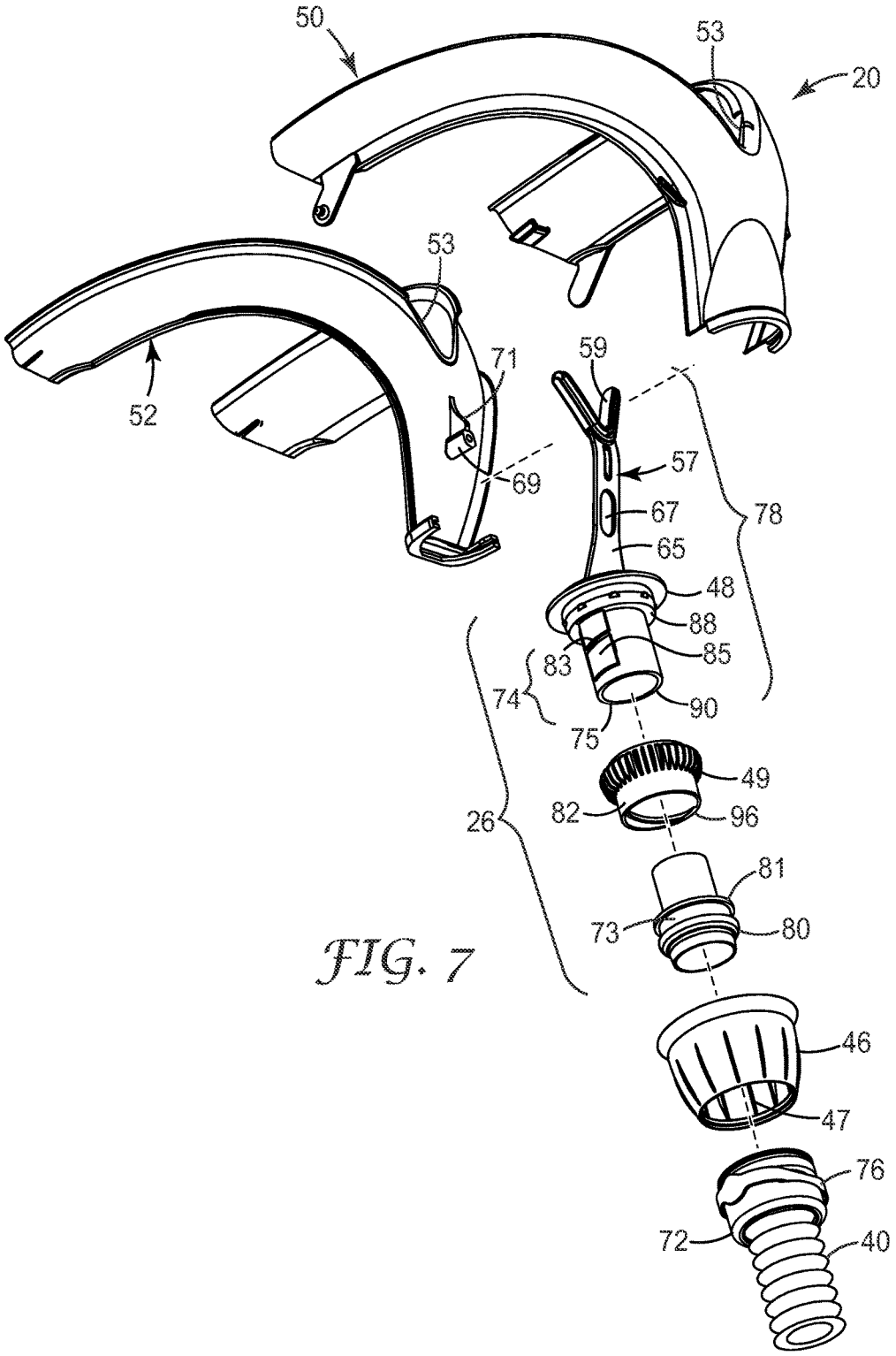
FIG. 7 is a partially exploded perspective view of the manifold for the respirator assembly.

FIG. 6 illustrates the manifold 20 in assembled form. FIG. 7 illustrates the manifold 20 in a partially exploded view, wherein in this embodiment, the manifold 20 has an upper half 50 and lower half 52. The upper and lower halves 50 and 52 are formed to fit or mate together to define the manifold 20, with the space between the upper and lower halves 50 and 52 forming air delivery conduits 28 and 27 (that are in fluid communication with the air inlet conduit 26 coupled thereto). Upon assembly, the upper and lower halves 50 and 52 are secured together by a plurality of suitable fasteners (such as threaded fasteners) or may be mounted together using thermal or ultrasonic bonding techniques, or other suitable fastening arrangement.

Referring now to FIG. 7, a valve 51 is provided for the manifold to allow the release of air flowing therethrough through one or more openings in the manifold 20 prior to the air reaching the air outlets 32 of the air delivery conduits 28. In the illustrated embodiment, a valve opening 53 is provided in the manifold 20 at the point where the manifold 20 splits (symmetrically) from one air delivery conduit 27 to two air delivery conduits 28*a* and 28*b*, such as at juncture area 55. Thus, air flowing out of the opening 53 flows alongside and over the head of a user, as indicated by arrow 54 in FIG. 1.

Figure 8:
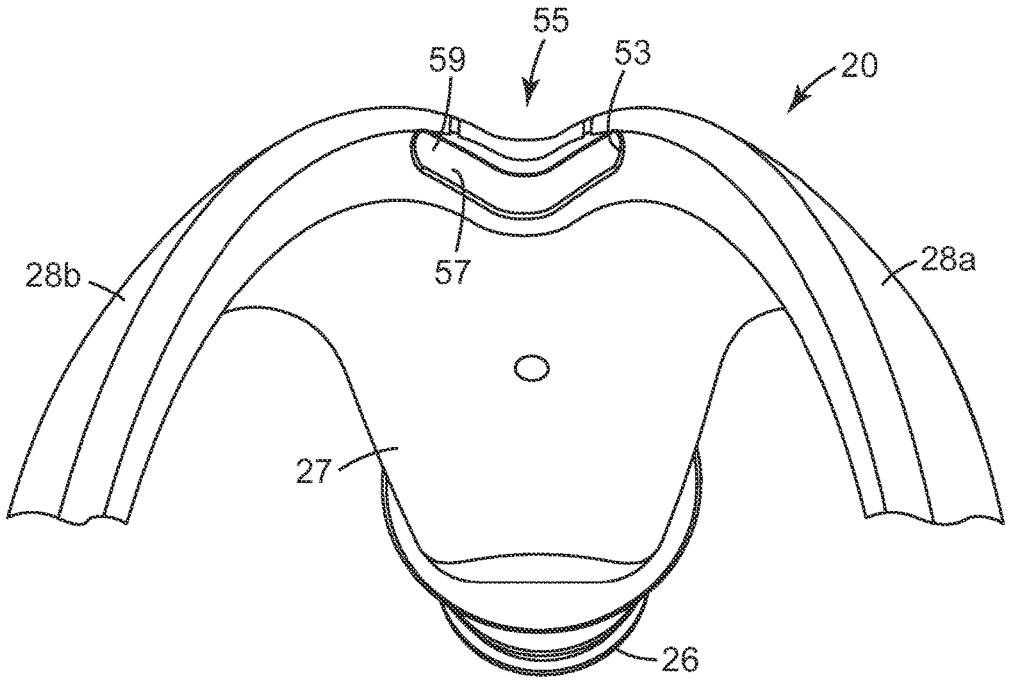
FIG. 8 is an enlarged perspective view of a portion of the manifold of FIG. 1, as viewed from the front of the manifold and showing the valve in a closed position.
Figure 9:
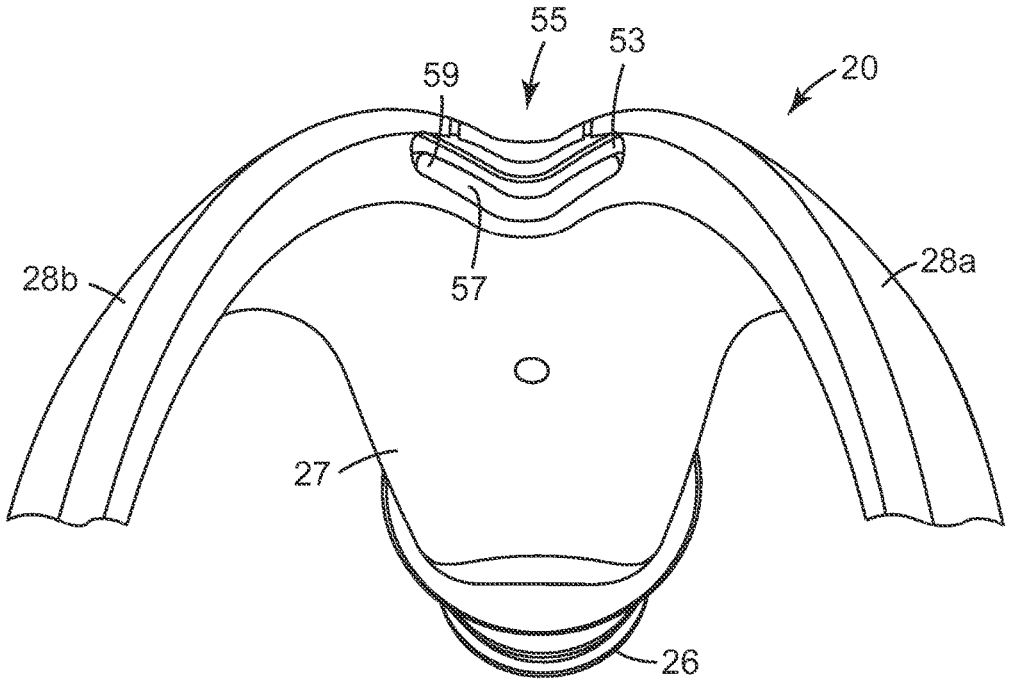
FIG. 9 is a view similar to FIG. 8, showing the valve in an open position.

A valve 51 comprises a valve member 57 (FIG. 7) that is moveable to selectively open and close the opening 53 in the manifold 20. The valve member 57 includes a valve face seal 59 which is shaped to mate with the opening 53. The valve member 57 is moveable toward and away from the opening 53 to close and open it, respectively. Accordingly, the valve member 57 moves in a linear or lateral fashion, generally along an axis of the air inlet conduit 26. FIG. 8 illustrates the valve member 57 moved with its valve face seal 59 into the opening 53 to close it, while FIG. 9 illustrates the valve member 57 with its valve face seal 59 moved away from the opening 53, thereby unsealing it and permitting the flow of air therethrough from within the manifold 20.

Figure 10:
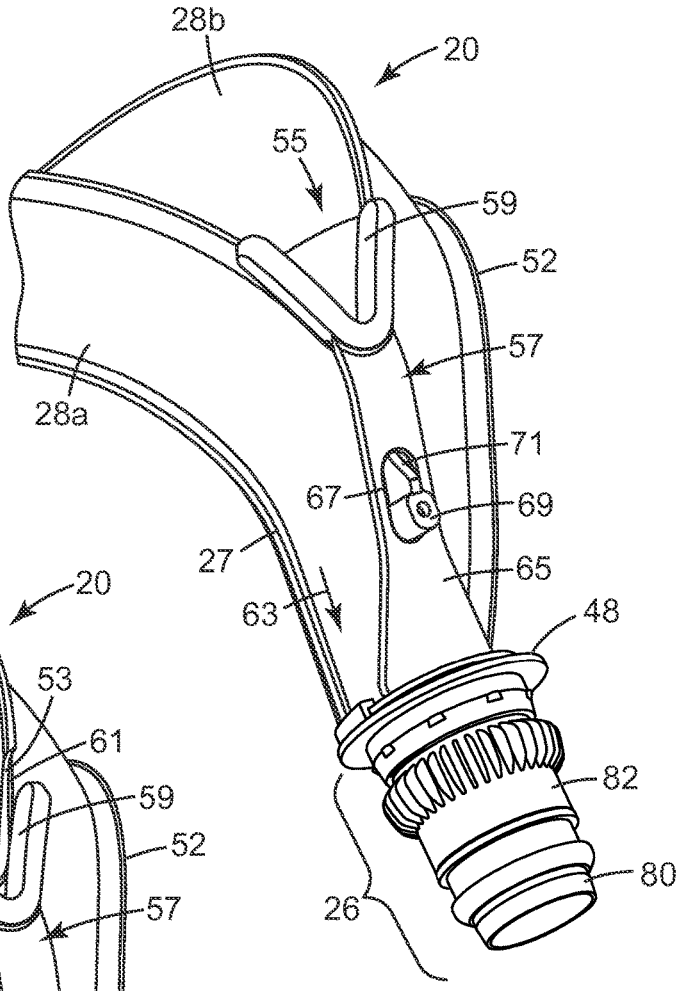
FIG. 10 is an enlarged perspective view of a portion of the manifold of FIG. 1, with an upper half of the manifold removed, showing a valve and actuator therefore in a closed position.
Figure 11:
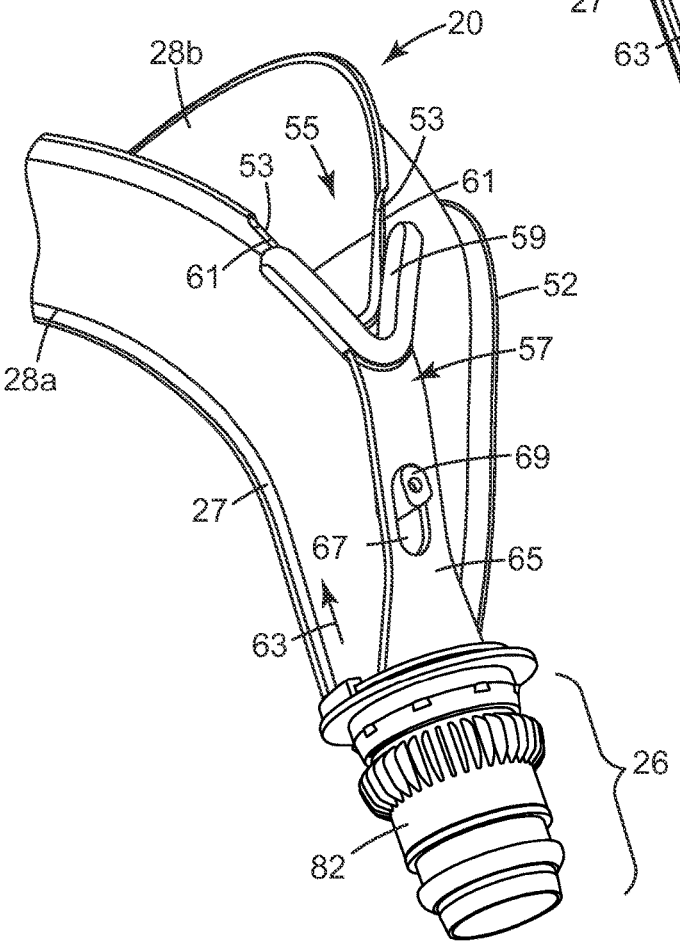
FIG. 11 is a view similar to FIG. 10, showing the valve and actuator in an open position.

FIGS. 10 and 11 further illustrate the valve member 57 and its interaction with the valve opening 53, where the upper half 50 of the manifold is removed. The valve member 57 moves linearly relative to the opening 53, by sliding back and forth, in direction of arrows 63 in FIGS. 10 and 11. The valve member 57 is formed from an arm 65 that at a first end is joined or formed as the valve face seal 59. The valve face seal 59 is shaped to mate with interior edges 61 (FIG. 11) of the valve opening 53. The arm 65 has an elongated aperture 67 therein. A spacer 69 between the upper and lower halves 50 and 52 of the manifold 20 extends through the elongated aperture 67. The spacer 69 includes an arm ramp surface 71 that is disposed for engagement with an edge of the elongated aperture 67 in the arm 65. Thus, when the arm 65 is moved away from the valve opening 53, the arm ramp surface 71 urges portions of the arm 65 upwardly away from the lower half 52 of the manifold 20 (as illustrated in FIG. 11). When the arm 65 is moved toward the valve opening 53, the arm ramp surface 71 allows the valve face seal 59 to lower into a sealed closure position relative to the opening 53 (as illustrated in FIG. 10). As a result, the arm ramp surface 71 guides the arm so that the valve face seal is lowered into a sealed position or lifted into an open position. The spacer 69 acts as a side-to-side guide of arm 65 so that the valve face seal 59 properly aligns with the valve opening 53.

Now referring to FIG. 7 and FIGS. 12 to 15, the components that make up the air inlet conduit 26 will be described. FIG. 7 is a partially exploded view of the manifold 20 that includes the components of the air inlet conduit 26. In the embodiment shown in FIGS. 7 to 15, several components fit together in order to enable the outer device 46 to move the valve member 57 between an open position and a closed position. The outer device 46 is capable of being rotated on the air inlet conduit 26, and this rotational movement is translated into linear movement of the valve member 57, as is described herein. The outer device acts to move the valve member 57, and therefore can alternatively be referred to as a valve actuator or an outer valve actuator device.

Now referring to FIG. 7, the air inlet conduit 26 includes a cylindrical body 74, a hose retainer 80, and a rotary mechanism 82 sandwiched between them. The rotary mechanism 82 is free to rotate on the cylindrical body 74 and is held onto the cylindrical body 74 by the retainer 82. The cylindrical body 74 has a groove 83 defined in its outer surface. The groove 83 includes two portions that are not connected. One portion of the groove 83 is shown in FIG. 7. The other portion of the groove 83 is on the opposite side of the cylindrical body 74 and is not visible in FIG. 7. The groove is not continuous around the cylindrical body 74, but the two portions of the groove are positioned along a helical path around the cylindrical body 74. The cylindrical body 74 also includes a first end 88 and a second end 90.

To assemble the air inlet conduit 26, the rotary mechanism 82 is slid over the second end 90 of the cylindrical body 74, toward the first end 88. As seen in more detail in FIG. 13, the rotary mechanism 82 has a thread 96 or ridge on its inner surface. The thread 96 follows a helical path. Referring again to FIG. 7, the rotary mechanism 82 is positioned and rotated as it is slid onto the cylindrical body 74 so that the thread 96 mates with the groove 83.

Once the rotary mechanism 82 is in position on cylindrical body 74, then it is time for the hose retainer to be attached to the cylindrical body 74. The end of the hose retainer 80 is received by the second end 90 of the cylindrical body 74. The hose retainer 80 and the cylindrical body 74 have structures that allow a mechanical snap-fit connection of these two parts, such as mating tab and tab receiver structures. For simplicity, these connection structures are not shown in FIG. 7. The mechanical connection between the cylindrical body 74 and the hose retainer 80 is a semi-permanent connection which can withstand a mechanical pull strength test. The parts can be disassembled using a tool, in case the user desires to clean these parts.

The hose retainer 80 includes a ridge 81 having an outer diameter greater than the inner diameter of the rotary mechanism 82. As a result, the hose retainer 80 holds the rotary mechanism 82 in place on the cylindrical body 74. The rotary mechanism 82 is free to rotate on the cylindrical body 74, but cannot be removed from the cylindrical body unless the hose retainer 80 is disconnected from the cylindrical body 74.

Figure 14:
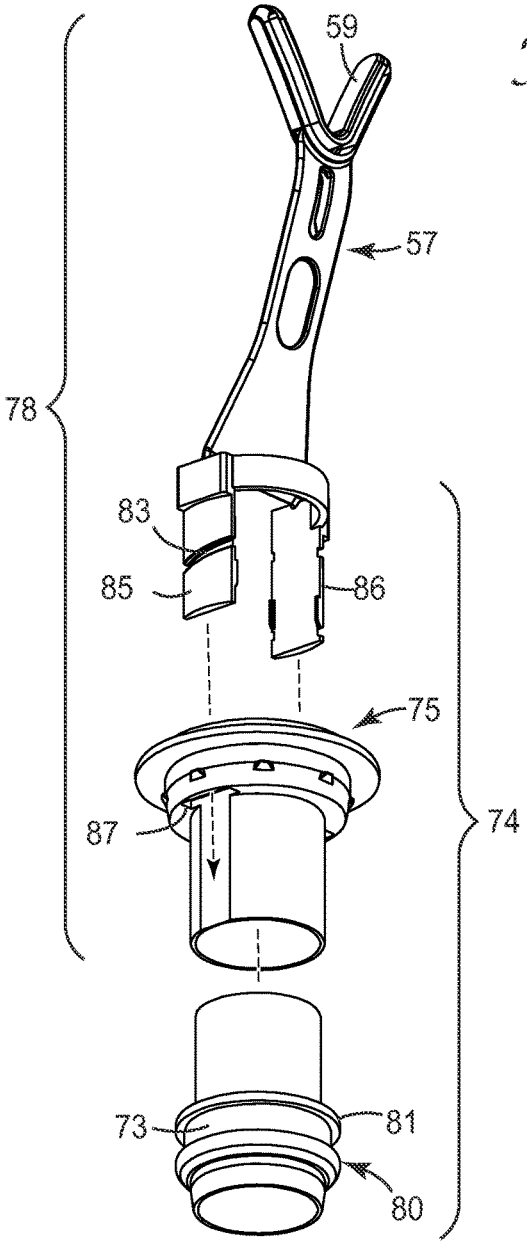
FIG. 14 is an exploded view of a base component of the air inlet conduit.

The structure of the cylindrical body 74 seen in FIG. 7 will now be described in additional detail. FIG. 14 is an exploded view of the cylindrical body 74. Three parts fit together to form the cylindrical body 74: the valve member 57 having legs 85 and 86, a receiver body 75 and a hose retainer 80. Together, the valve member 57 and the receiver body 75 constitute the base 78. The valve seal face 59 is located at one end of the valve member 57, and at the opposite end, the two leg structures 85 and 86 are present. The leg structures 85 and 86 define the groove 83 on their outer surface. The outer surface of each leg structure 85 and 86 has a portion of the groove 83. The groove portions are positioned along a helical path around the cylindrical body 74.

Figure 15:
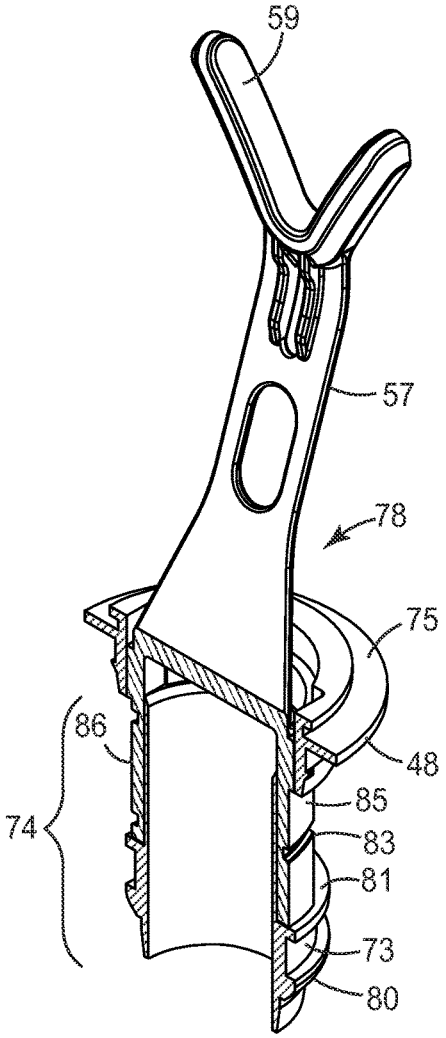
FIG. 15 is a cross-sectional view of the base component of FIG. 14.

When the cylindrical body 74 is assembled, the legs 85 and 86 fit into openings on the receiver body 75. As seen in FIG. 14, leg structure 85 fits into an opening 87. Leg structure 86 fits into another opening of the receiver body 75 that is not visible in FIG. 14. The combination of the valve body 57 and the receiver body 75 is the base 78. The rotary mechanism 82 (not shown in FIG. 14) is then slid over the receiver base 78. Then the hose retainer 80 is attached by sliding an end of the hose retainer 80 within the base 78. For simplicity, the mechanical structures that allow a secure fit between the hose retainer and the base 78 are not illustrated in FIG. 14. FIG. 15 shows a cross-sectional assembled view of the valve member 57, receiver body 75 and hose retainer 80.

Figure 12:
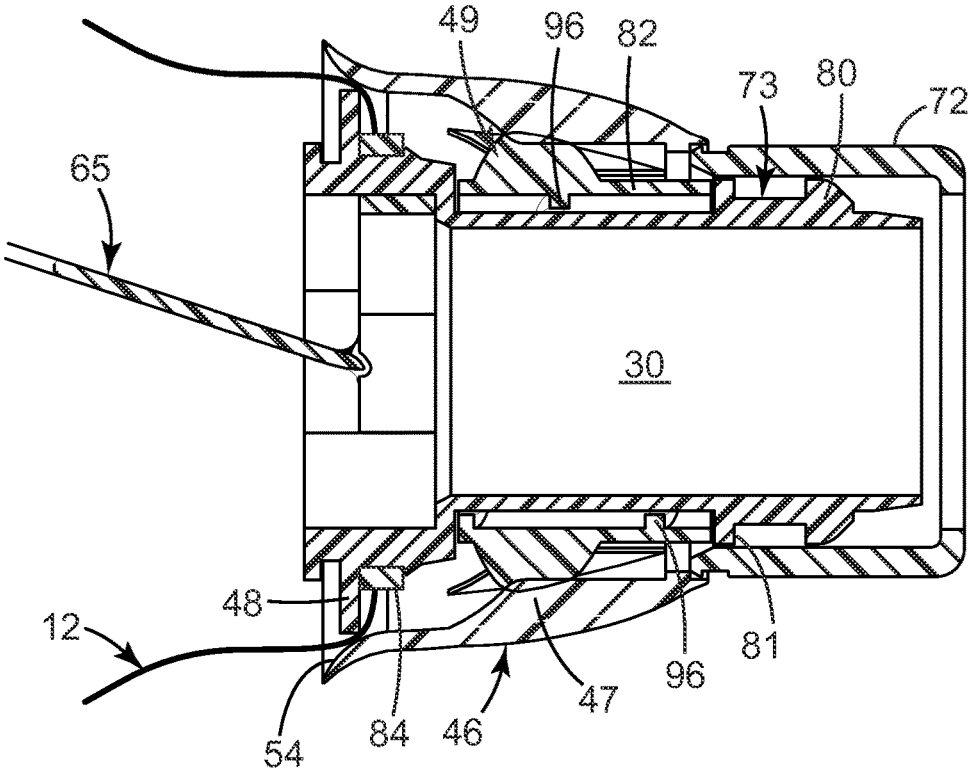
FIG. 12 is an enlarged cross sectional view of the assembled air inlet conduit with the outer device and hose connector.
Figure 13:
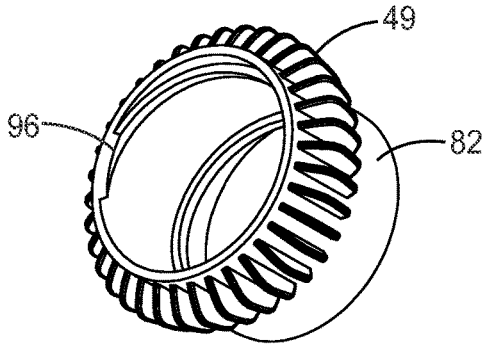
FIG. 13 is a perspective view of a rotary mechanism component of the air inlet conduit from its end.

The interaction of the outer device 46 with components of the air inlet conduit 26 to cause the opening and closing of the valve 51 will now be described. When the respirator system is worn by a user, the outer device 46 is located on the exterior side of the hood 12. As a result, the user can easily manipulate the outer device 46. The outer device 46 includes ridge structures 47 on its inner surface, as shown in FIGS. 5, 7 and 12. When the outer device 46 is positioned over the rotary mechanism 82 of the air inlet conduit 26, the ridge structures 47 fit in between the cooperating structures 49 of the rotary mechanism 82. Hence, rotation of the outer device 46 causes rotation of the rotary mechanism 82.

As the rotary mechanism 82 is rotated on the cylindrical body 74, the ridge 96 travels along the helical path of the groove 83, causing the legs 85 and 86 and the entire valve member 57 to move toward or away from the valve opening 53, thereby causing the valve face seal 59 to move linearly relative to the valve opening 53, thereby opening and closing the valve. Accordingly, the rotational movement of the outer device 46 results in linear movement of the valve member 57.

The components of the air inlet conduit 26 are dimensioned relative to each other so that no appreciable amount of air may escape from the spaces between the components. In one embodiment, the valve opening 53 is formed so that no more than 50% of the air flowing through the manifold 20 can flow through the valve opening 53. The amount of air flow through the valve opening 53 is variable dependent upon the position of the valve face seal 59 relative to the valve opening 53, with flow permitted at any flow level between fully closed (FIGS. 8 and 10) and fully opened (FIGS. 9 and 11).

The outer device 46, as seen in FIGS. 4 and 5, is outside of the material of the hood 12, and thus is accessible by a user when the hood is being worn in order to manipulate the position of the valve member 57 relative to the opening 53. The valve member 57 thus serves to vary the amount of air flowing through the manifold 20 to its air outlets 32. If the valve member 57 is opened at all, air will flow out of the valve opening 53, and thus less air will flow out of the air outlets 32. The amount of longitudinal travel of the valve member 57 is limited by, on the one hand, engagement of the valve seal face 59 with the valve opening 53. On the other hand, the amount of longitudinal travel of the valve member is limited by engagement of the end of ridge 96 of the rotary mechanism 82 with the groove 83. The contact of the ends of the legs 85 and 86, respectively, with the ridge 81 provides the user with a tactile indication that the valve is in a fully open position.

FIGS. 16 to 21 illustrate an alternative embodiment of the manifold, where some aspects of the air inlet conduit are configured differently than illustrated in FIGS. 3-7 and FIGS. 10-15. Specifically, referring to FIG. 16, outer device 246 and rotary mechanism 282 have differently shaped interlocking structures than the outer device 46 and rotary mechanism 82 shown in the first embodiment. Other differences will also be described. Throughout the description of this application, like reference numbers indicate like parts. For example, hood 12 and hose 40 are identical to those described with respect to the first embodiment. In the description of the second embodiment pictured in FIGS. 16-21, the parts of the second embodiment that are similar to the parts of the first embodiment will have similar reference numbers but that begin with a "2". For example, the outer device 46 of the manifold 20 in the first embodiment is similar to the outer device 246 of the manifold 220 of the second embodiment.

Figure 16:
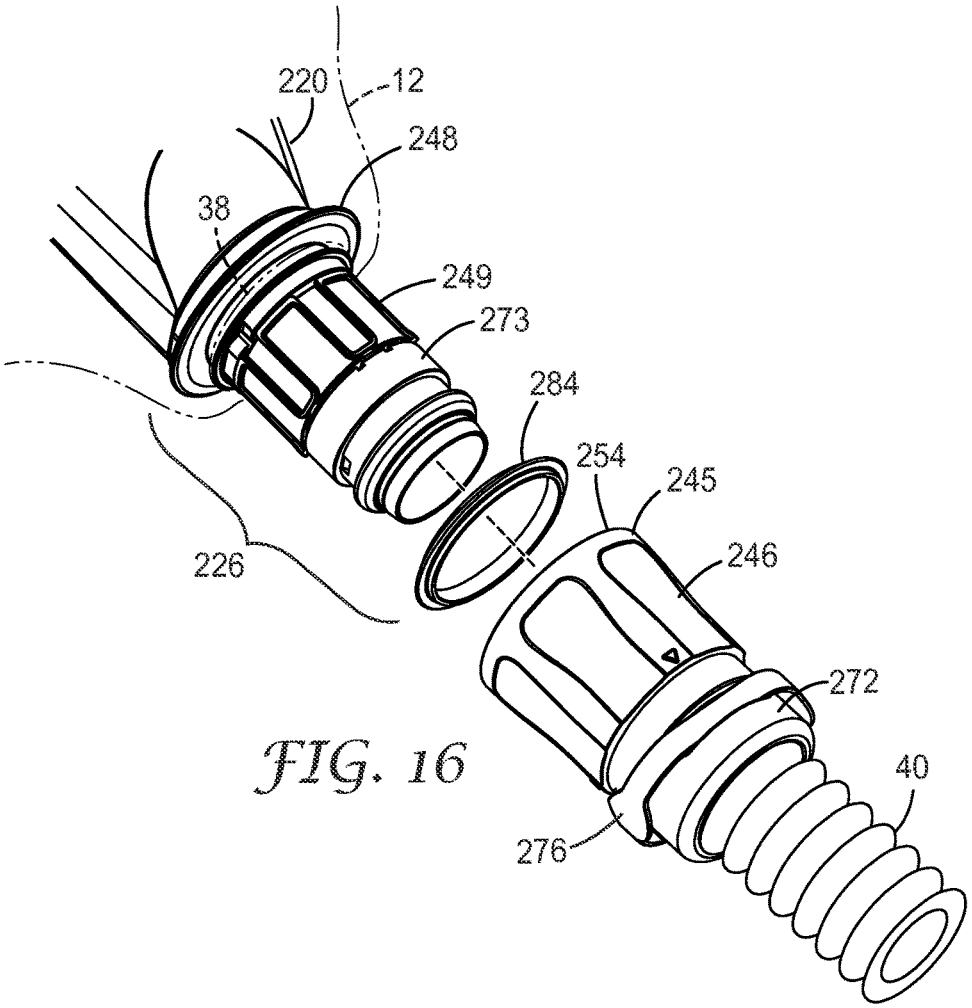
FIG. 16 is a partially exploded perspective view of a second embodiment of a manifold for a respirator assembly, with a respirator shell shown in phantom over a shoulder of an air inlet conduit.
Figure 17:
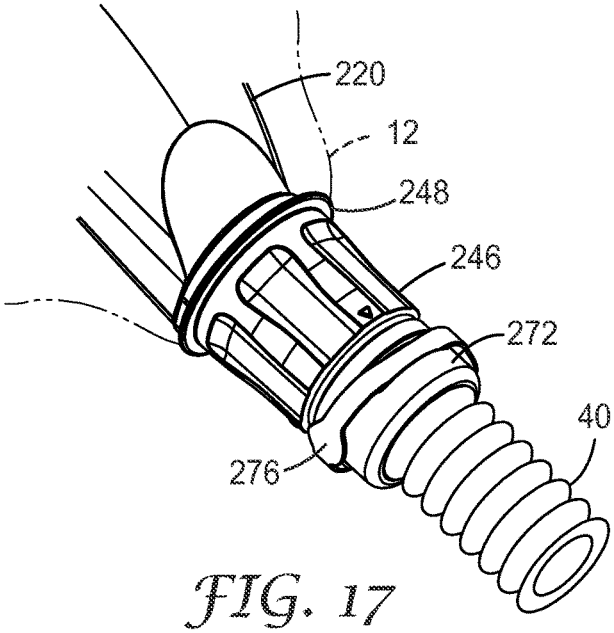
FIG. 17 is an enlarged perspective view of the assembled manifold and hose connection with a respirator shell shown in phantom for the second embodiment of the invention as shown in FIG. 16.
Figure 21:
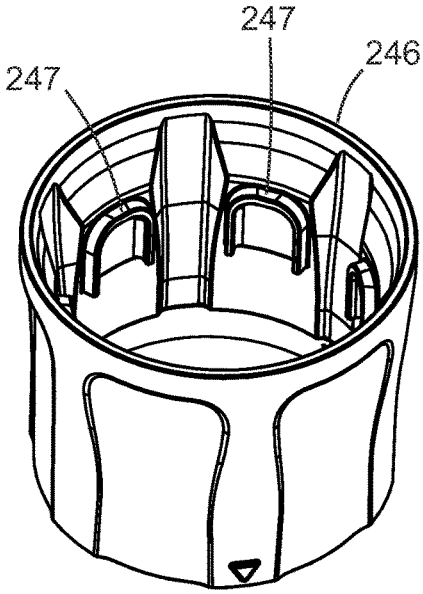
FIG. 21 is a perspective view of an outer device of the second embodiment of the invention as shown in FIG. 16.

FIGS. 16 and 17 illustrate a portion of the manifold 220 emerging from the air inlet opening 38 of the hood 12, where the hood 12 is shown in phantom lines for clarity of illustration. The air inlet conduit 226 extends through the air inlet opening 38 of the hood 12. The outer device 246 is received on the air inlet conduit 226 on an external side of the hood 12. The outer device 246 is shown positioned near the air inlet conduit 226 in FIG. 16 and shown positioned on the air inlet conduit in FIG. 17. FIG. 21 is a perspective view of the outer device 246 from the end 245 closest to the manifold 220 in FIG. 16. As seen in FIGS. 16 and 21, the outer device 246 has structures 247 on its interior surface which engage cooperative structures 249 on the air inlet conduit 226. The hood material adjacent the air inlet opening 38 is urged against an annular shoulder 248 of the air inlet conduit 226 by a lip 254 of the outer device 246. Lip 254 of the outer device 246 and shoulder 248 thus cooperate to form a seal between the hood 12 and manifold 220 where the manifold 220 passes through the air inlet opening 38 of the hood 12.

Figure 18:
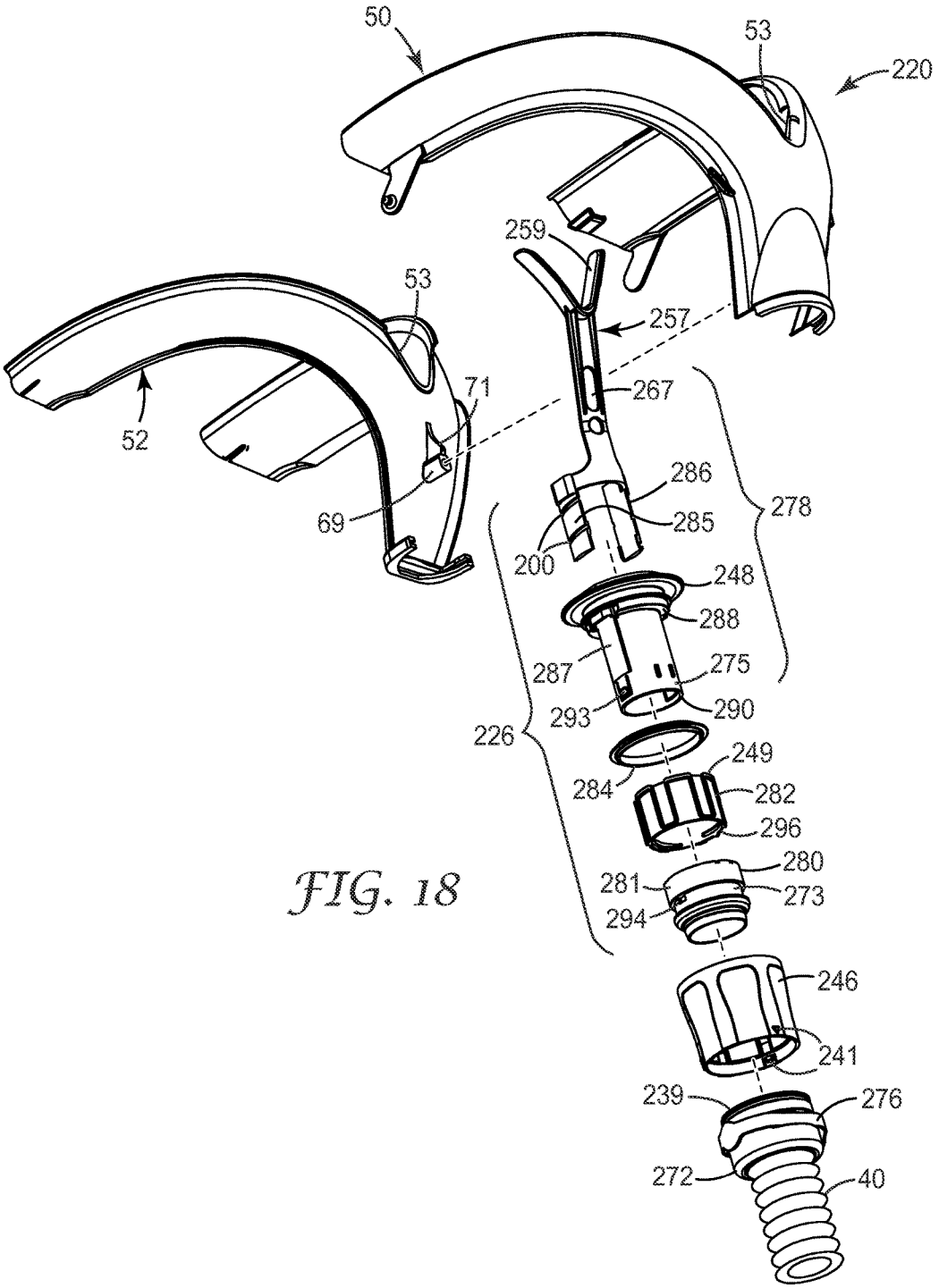
FIG. 18 is an exploded perspective view of the manifold for the respirator assembly of the second embodiment of the invention as shown in FIG. 16.
Figure 19:
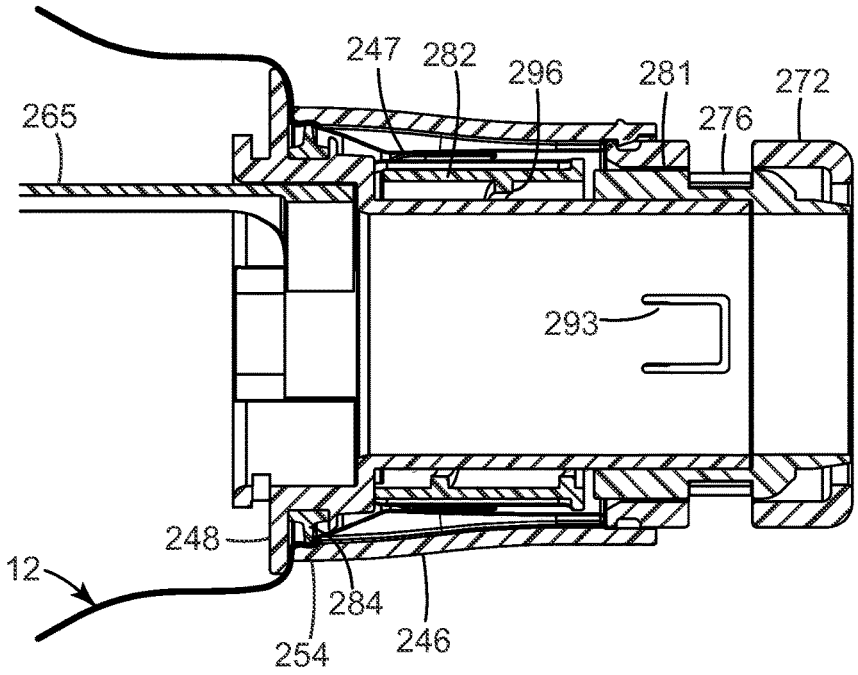
FIG. 19 is an enlarged cross sectional view of the assembled air inlet conduit with the outer device and hose connector of the second embodiment of the invention as shown in FIG. 16.

In some embodiments, a gasket 284 is positioned between the annular shoulder 248 and the outer device 246 to improve the seal, either over or under the hood 12. In the embodiment of FIGS. 16-21, the gasket is under the hood and the gasket is normally positioned on the air inlet conduit 226, abutting the annular shoulder 248, when the system is provided to the user. FIG. 19 is a cross-sectional view of assembled air inlet conduit with the outer device in place, and shows how the hood material 12 is sealed against the annular shoulder 248 by the outer device 246.

In some embodiments, the gasket is integral with either the outer device 246 or the annular shoulder 248. For example, in some embodiments, the gasket is bonded to the outer device or annular shoulder, or integrally formed with the outer device or annular shoulder, such as in a molding process. In other embodiments, the gasket is mechanically retained on the outer device or the annular shoulder by a groove or other structure.

In the embodiment illustrated in FIGS. 16 and 21, the structures 247 of the outer device 246 are ridges that extend along the longitudinal axis of the interior surface of the outer device 246. In the particular embodiment in FIGS. 16 and 21, the ridges 247 of the outer device 246 each follow a U-shaped path on the interior surface of the outer device 246.

The cooperative structures 249 of the air inlet conduit are also ridges in the embodiment of FIG. 16. In one embodiment, one ridge 249 follows a path along the outer surface of the air inlet conduit 226, where some segments are longitudinal and some segments follow a circular path along the outer cylindrical surface of the air inlet conduit, connecting the longitudinal segments. The ridge 249 forms U-shaped segments that can receive the U-shaped ridges of the outer device 246.

Now referring to FIGS. 18 to 20, the components that make up the air inlet conduit 226 will be described. FIG. 18 is an exploded view of the manifold 220 that includes the components of the air inlet conduit 226. The manifold 220 fits together in a very similar way as the manifold 20 as described with respect to FIG. 7. Several components fit together in order to enable the outer device 246 to move the valve member 257 between an open position and a closed position. The outer device 246 is capable of being rotated on the air inlet conduit 226, and this rotational movement is translated into linear movement of the valve member 257.

The air inlet conduit 226 includes a valve member 257, a receiver body 275, a rotary mechanism 282, and a hose retainer 280. During the assembly process, the legs 285 and 286 of the valve member 257 are inserted into the receiver body 275, so that leg 285 is received in opening 287. Leg 286 is received in an opening that is not visible in FIG. 18 on the opposite side of the receiver body 275.

Then the rotary mechanism 282 is slid over an end 290 of the receiver body 275, toward the end 288. Next the hose retainer 280 is attached by sliding an end of the hose retainer 280 within the receiver body 275. The hose retainer 280 defines a groove 273 which is configured to be attached to a hose connector 272 for placing a hose 40 in fluid communication with the air inlet conduit. A squeezable band 276 of the hose connector 272 fits within the groove 273.

Mechanical structures allow a secure fit between the hose retainer 280 and the receiver body 275. For example, a tab 293 on the receiver body is received by an opening 294 on the hose retainer 280. Many other mechanical interlocking structures are possible. The mechanical connection between the receiver body 275 and the hose retainer 280 is a semi-permanent connection which can withstand a mechanical pull strength test. The parts can be disassembled using a tool, in case the user desires to clean these parts.

The hose retainer 280 includes a ridge 281 having an outer diameter greater than the inner diameter of the rotary mechanism 282. As a result, the hose retainer 280 holds the rotary mechanism 282 in place on the receiver body 275. The rotary mechanism 282 is free to rotate on the receiver body 275, but cannot be removed from the receiver body 275 unless the hose retainer 280 is disconnected from the receiver body 275.

Figure 20:
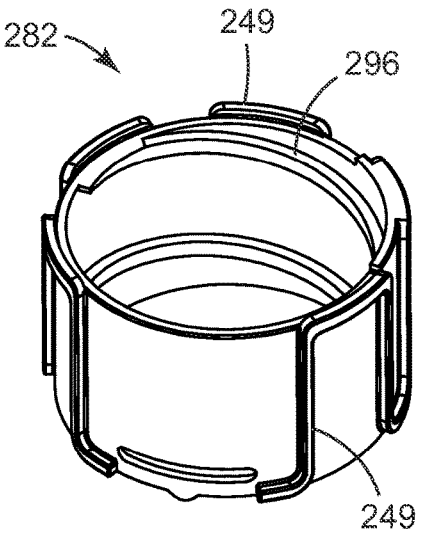
FIG. 20 is a perspective view of a rotary mechanism of the second embodiment of the invention as shown in FIG. 16.

As seen in more detail in FIG. 20, the rotary mechanism 282 has a thread 296 or ridge on its inner surface. The thread 296 follows a helical path. Referring again to FIG. 18, the rotary mechanism 282 is positioned and rotated as it is slid onto the receiver body 275 so that the thread 296 mates with a groove 283. The leg structures 285 and 286 define the groove 283 on their outer surface. The outer surface of each leg structure 285 and 286 has at least one portion of the groove 283. In the embodiment of FIG. 18, two portions of groove 283 are present on leg 285. The groove portions are positioned so that they are along a helical path.

The outer device 246 and hose connector 272 are connected to each other in a way that allows outer device 246 to rotate with respect to hose connector 272. In one embodiment, these two parts are connected in a semi-permanent matter before the system is provided to the user, so that the user has fewer parts to handle when using the system. In the embodiment illustrated in FIG. 18, three protrusions are present on the inner surface of outer device 246 at its end. One of these protrusions 239 is visible in FIG. 18, and the position of a second protrusion 239 is marked on the outer surface of 246. These protrusions are received by a groove 241 near the end of the hose connector 272. The outer device 249 can be disassembled from the hose connector 272 with the use of a tool, if the user desires to clean between these two parts. In alternative embodiments, the outer device 246 is separate from the hose connector 272.

The interaction of the outer device 246 with components of the air inlet conduit 226 to cause the linear movement of valve member 257 will now be described. When the respirator system is worn by a user, the outer device 246 is located on the exterior side of the hood 12. As a result, the user can easily manipulate the outer device 246. The outer device 246 includes ridge structures 247 on its inner surface, as shown in FIGS. 18 and 21. When the outer device 246 is positioned over the rotary mechanism 282 of the air inlet conduit 226, the ridge structures 247 fit in between the cooperating structures 249 of the rotary mechanism 282. Hence, rotation of the outer device 246 causes rotation of the rotary mechanism 282.

As the rotary mechanism 282 is rotated, the ridge 296 travels along the helical path of the groove 283, causing the legs 285 and 286 and the entire valve member 257 to move toward or away from the valve opening 53, thereby causing the valve face seal 259 to move linearly relative to the valve opening 53, thereby opening and closing the valve. Accordingly, the rotational movement of the outer device 246 results in linear movement of the valve member 257.

The valve member 257 is formed from an arm 265 that at a first end is joined or formed as the valve face seal 259. The valve face seal 259 is shaped to mate with edges of the valve opening 53. Like described with respect to the first embodiment, the arm 265 has an elongated aperture 267 therein. A spacer 69 between the upper and lower halves 50 and 52 of the manifold 220 extends through the elongated aperture 267. The spacer 69 includes an arm ramp surface 71 that is disposed for engagement with an edge of the elongated aperture 267 in the arm 265. The arm ramp surface 71 guides the arm 265 so that the valve face seal 259 is lowered into a sealed position or lifted into an open position. The spacer 69 acts as a side-to-side guide of arm 265 so that the valve face seal 259 properly aligns with the valve opening 53. Thus, linear movement of the valve member 257 opens and closes the valve opening 53.

The manifolds 20 and 220 illustrated in the FIGS. and described herein, in addition to the alternative embodiments described herein thus provide a shape stable manifold having a valve which is rotatably operable from outside of the respirator hood to open and close the valve opening within the manifold inside of the shell of the respirator assembly. This actuation is achieved by rotational movement of a valve actuator on the outside of the hood adjacent the back of the user's head. Thus, a user can easily modify the air flow through the manifold between a condition where all air flowing through the manifold exits the manifold adjacent the facial area via the air outlets and a condition where some or up to half of the air flowing through the manifold exits the manifold through the valve opening 53, thereby flowing across the back and top of the user's head.

Figure 22:
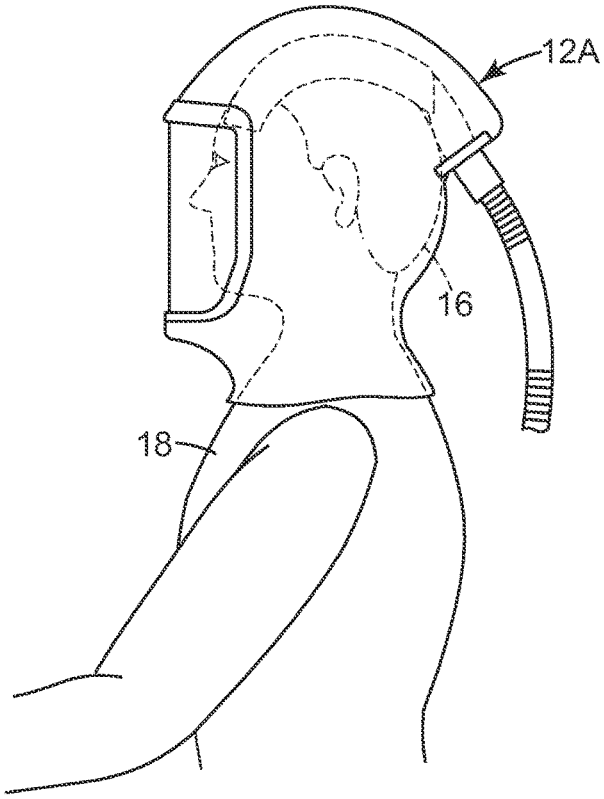
FIG. 22 is a side elevation of a respirator assembly with a respirator hood covering the entire head of a user.
Figure 23:
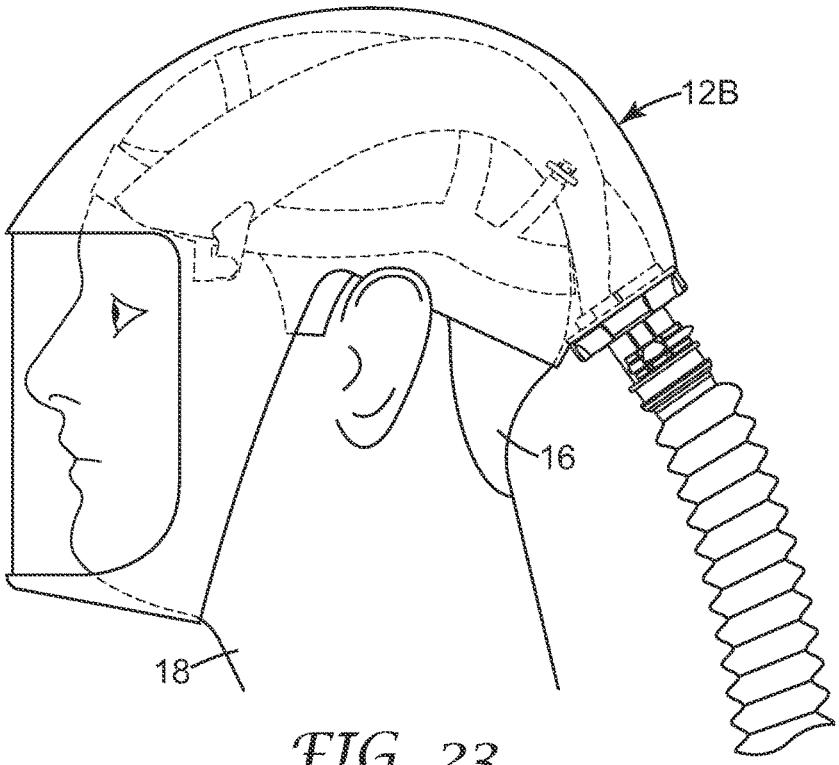
FIG. 23 is a side elevation of a respirator assembly with a head cover style respirator hood that only partially covers the head of a user.
Figure 24:
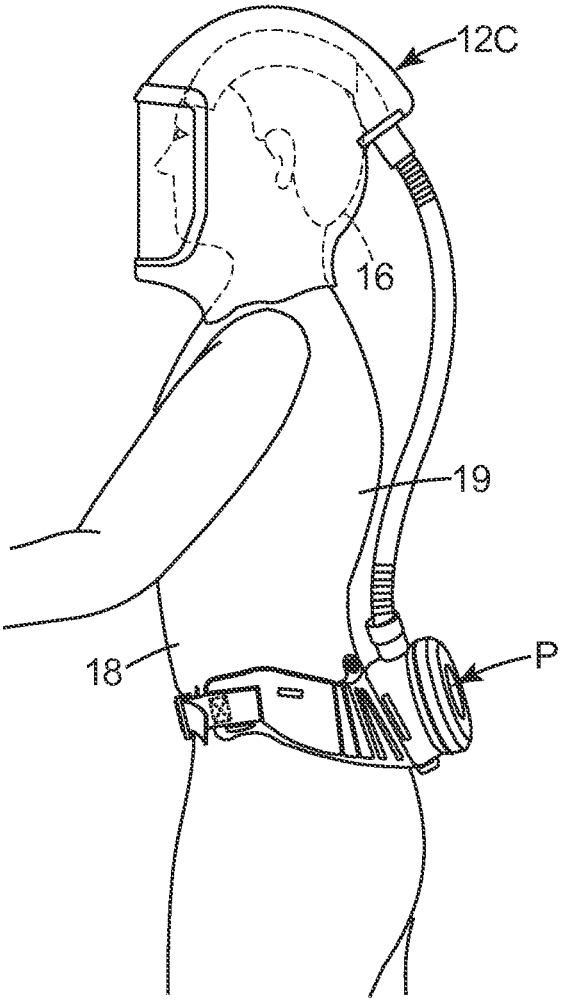
FIG. 24 is a side elevation of a respirator assembly with a respirator hood that entirely covers the head of the user and is used in combination with a full protective body suit worn by the user.

As noted above, the respirator assembly includes a hood. An exemplary hood is illustrated in FIG. 1. FIGS. 22 to 24 further illustrate exemplary hoods which may be used in connection with the respirator assembly of the present disclosure. FIG. 22 illustrates a hood 12A that is sized to cover the entire head 16 of a user 18, with an apron at its bottom end, adjacent the user's shoulders. FIG. 23 illustrates an alternative hood 12B, which is sometimes referred to as a head cover, wherein the hood 12B covers only a top and front portion of the head 16 of a user 18, leaving the user's ears, neck and shoulders uncovered. The hood 12B seals about the user's head at its lower edges. FIG. 24 illustrates a hood 12C that entirely covers the head 16 of a user 18, but that is also used in combination with a full protective body suit 19 worn by a user 18. Each of the hoods 12A, 12B and 12C may be non-shape stable and incorporates a shape stable manifold such as disclosed herein within the shell of the respective hood. In the embodiment disclosed in FIG. 24, the manifold is coupled to a PAPR air and/or power supply P that is carried on a belt worn by a user 18.

Other alternative hood configurations are possible, and no matter what the configuration of the non-shape stable hood that defines the shell for respiration purposes, a shape stable manifold is included within that hood (such as the exemplary manifolds disclosed herein). The manifold typically receives air from a single air inlet, and distributes air to multiple air outlets within the hood, via multiple conduits therein. The manifold may be removable from the hood, thus allowing disposal of a soiled hood and reuse of the manifold. In addition, a head harness may be provided to mount the manifold and hood to the head of the user. The head harness likewise may be removable from the hood for reuse, and may also be removable from the manifold.

In the embodiments of the respirator assembly discussed above, the shell has been disclosed as a hood, such as a non-shape stable hood. The manifold disclosed is also operable within a helmet, which may have a shape stable shell. In that instance, the helmet comprises a shell but that shell would be (at least in part) impact resistant to some degree. The air delivery conduits of the manifold are within the shell of the helmet, and likewise moveable members of a valve structure are within one or more such conduits to provide air flow control within the manifold. The amount of flow control through different portions of the manifold is controlled by user manipulation of a valve actuator outside of the helmet's shell and adjacent thereto. For instance, the user controls air flow by movement of the actuator tabs disclosed above (which are disposed about the air inlet conduit for a manifold and adjacent a back side of a user's head, where the air is supplied to the respirator assembly).

Figure 25:
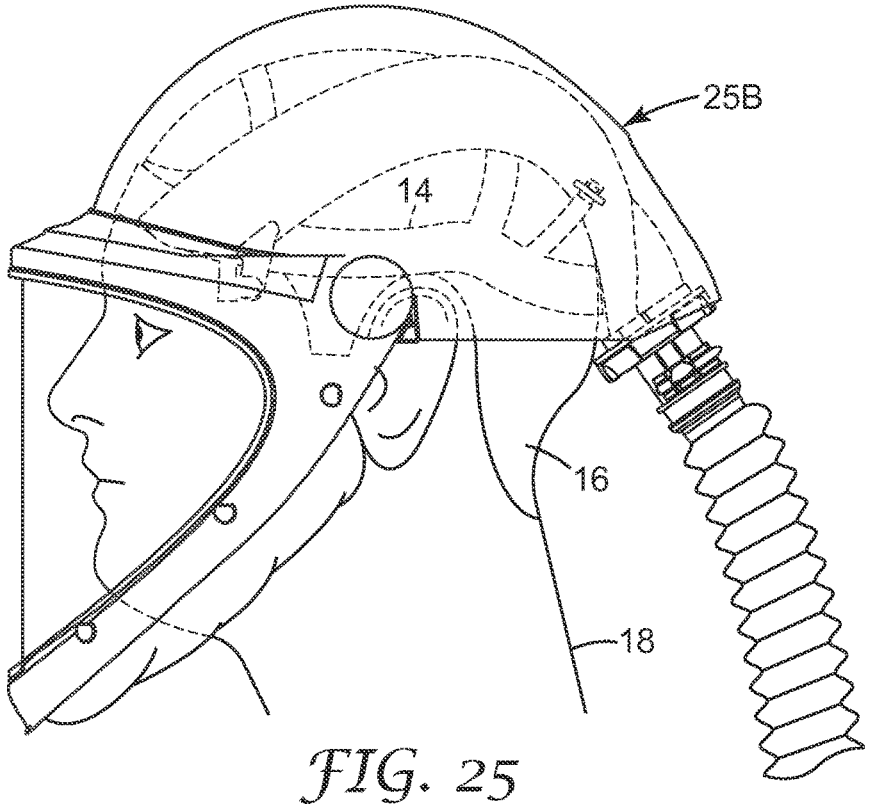
FIG. 25 is a side elevation of a respirator assembly with a hard shell helmet covering the top and facial area of the head of a user.
Figure 26:
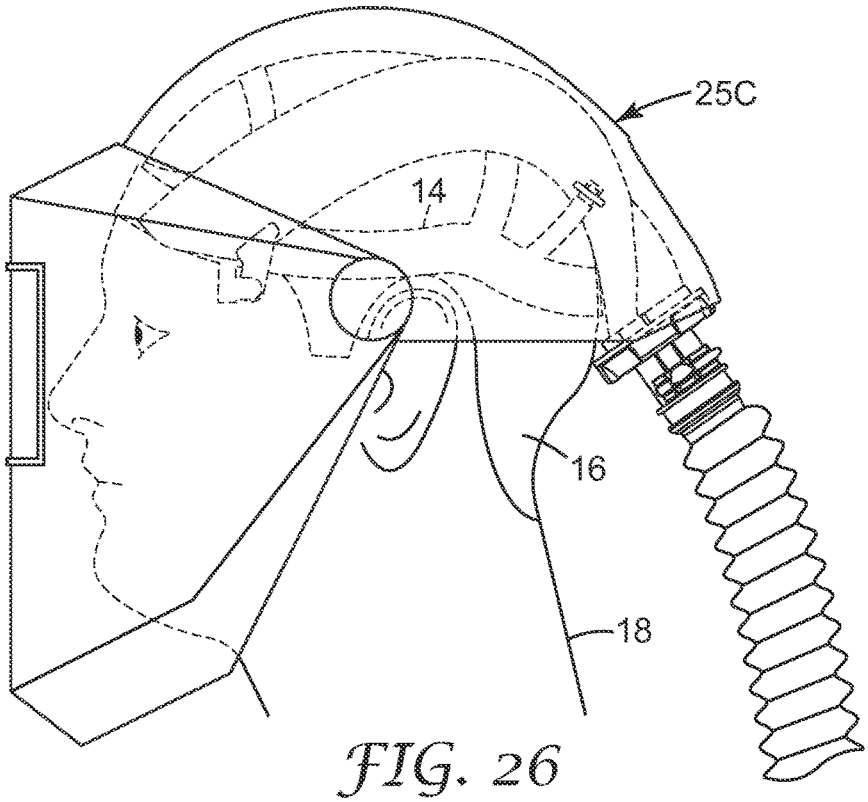
FIG. 26 is a side elevation of a respirator assembly with a hard shell helmet covering the top and facial area of the head of a user, in the general form of a welding mask.

Exemplary helmets for use in a respirator assembly are illustrated in FIGS. 25 to 26. FIG. 25 illustrates a helmet 25B that is sized to cover only the top of a user's head 16 along with the facial area thereof. FIG. 26 illustrates a helmet 25C that also covers at least the top of a user's head 16 and the facial area thereof. Helmet 25C is configured in the general form of a welding helmet.

In these exemplary illustrations, the helmet (such as helmets 25B or 25C) is rigid, has an at least partially hard shell and provides a breathable air zone for a user. Air is provided to that breathable air zone via the type of manifold disclosed herein, and the amount of air flow to the user's facial area and cooling air within the shell of the respective helmet is likewise controlled by the valve of that manifold. As noted above, the valve is manipulatable by a user while the user wears the respirator assembly and its helmet. The manifold may be fixed to the helmet, or may be removable therefrom. Likewise, a head harness (such as the exemplary head harness 14 shown in FIGS. 25 and 26) is provided to fit the respirator assembly to the head of a user, and to support the helmet and manifold. The harness 14 may be removable from the helmet and/or manifold.

Although the manifolds disclosed herein have been described with respect to several embodiments, workers skilled in the art will recognize that changes may be made in form and detail without departing from the spirit and scope of the respirator assembly disclosure. For instance, in some embodiments, the exemplary manifolds each have two symmetrically aligned air delivery conduits. However, it may not be essential in all cases that the conduit arrangement is symmetrical, and an asymmetrical arrangement may be desired for particular respirator assembly applications. In addition, while the illustrated embodiments disclose shape stable manifolds, it may be sufficient for the manifold to be shape stable merely adjacent the valve member of the valve, and thus have portions thereof that are non-shape stable. The valves illustrated are intended to be exemplary only, and other valve types are contemplated such as, for example, pin valves, plug valves, diaphragm valves and spool valves. Furthermore, the air outlets for some of the illustrated manifolds have been disclosed as generally above and to the side of a user's eye. Alternative locations for the air outlets are also contemplated, and the present disclosure should not be so limited by such exemplary features. In respirator assemblies where the hood defines the shell, the shell may be formed from, for example, such materials as fabrics, papers, polymers (e.g., woven materials, non-woven materials, spunbond materials (e.g., polypropylenes or polyethylenes) or knitted substrates coated with polyurethane or PVC) or combinations thereof. In alternative embodiments where the shell is a portion of a helmet, portions of the shell may be formed from, for example, such materials as polymers (e.g., ABS, nylon, polycarbonates or polyamides or blends thereof), carbon fibers in a suitable resin, glass fibers in a suitable resin or combinations thereof.

Various modifications and alterations of this invention will be apparent to those skilled in the art without departing from the scope and spirit of this invention, and it should be understood that this invention is not limited to the illustrative embodiments set forth herein. All U.S. patents, patent application publications, and other patent and non-patent documents referred to herein are incorporated by reference, to the extent they are not inconsistent with the foregoing disclosure.

What is claimed is:

1. An air flow control system for a respirator, the control system comprising:

a shell that defines a breathable air zone for a user wearing the respirator;

an air delivery conduit within the shell of the respirator, the air delivery conduit comprising at least one air outlet for delivering breathable air to the user's facial area, wherein the air delivery conduit is separable from the shell;

a valve member positioned in a valve opening prior to the at least one air outlet to vary the air flow through the valve opening and the at least one air outlet;

an air inlet conduit in fluid communication with the air delivery conduit and positioned upstream of both of the at least one air outlet and the valve opening; and an outer device outside of the shell of the respirator to control movement of the valve member, whereby when the valve member is closed, air will flow through the air inlet conduit and out of the at least one air outlet, but not out of the valve opening.

2. The system of claim 1, wherein the outer device has first structures on an inner surface and the inner surface defines a passageway through the outer device, wherein the first structures mate with second structures on an outer surface of the air inlet conduit so that rotation of the outer device causes rotation of the second structures.

3. The system of claim 2, wherein the air inlet conduit comprises a rotating member having an inner surface and an outer surface, where the outer surface of the rotating member includes the second structures, where the inner surface of the rotating member defines a portion of a helical thread configured so that rotation of the outer device causes rotation of the rotating member, thereby causing movement of the valve member relative to the air delivery conduit.

4. The system of claim 3, wherein the air inlet conduit further comprises a groove following at least a portion of a helical path, wherein the helical thread is configured to fit within the groove.

5. The system of claim 1, wherein the air inlet conduit has an air flow inlet end outside of the shell of the respirator, wherein the air delivery conduit has at least a first opening, and wherein the valve member is movable relative to the first opening to vary the effective air flow size of the first opening.

6. The system of claim 5, wherein the first opening is configured to be positioned at a back area of a head of a user.

7. The system of claim 1, wherein the air inlet conduit is shape stable.

8. The system of claim 1, wherein the valve member fits within the valve opening and the valve member is movable in a linear direction relative to the valve opening.

9. The system of claim 1, wherein the air delivery conduit is in fluid communication with a manifold, wherein the manifold includes the at least one air outlet.

10. The system of claim 1, wherein the air delivery conduit is shape stable.

11. The system of claim 1, wherein the air inlet conduit extends out of an opening in the shell.

12. The system of claim 1, further comprising:

a hose;

a hose connector configured to connect the hose to the air inlet conduit.

13. The system of claim 12, wherein the hose connector is removable from the air inlet conduit.

14. The system of claim 1, wherein the valve opening delivers air over the user's head.

15. The system of claim 1, wherein the valve member is configurable to open and close the valve opening.

16. An air flow control system for a respirator, the control system comprising:

a shell that defines a breathable air zone for a user wearing the respirator;

an air delivery conduit within the shell of the respirator, the air delivery conduit comprising at least one air outlet for delivering breathable air to the user's facial area;

a valve member configurable to open and close a valve opening prior to the at least one air outlet to vary the air flow through the valve opening and the at least one air outlet, wherein the air delivery conduit includes a right branch and a left branch and the valve opening is positioned at a juncture of the right and left branches, wherein the at least one air outlet comprises a first air outlet associated with the right branch of the air delivery conduit and a second air outlet associated with the left branch of the air delivery conduit, wherein the first air outlet is different than the second air outlet;

an air inlet conduit in fluid communication with the air delivery conduit and positioned upstream of both of the at least one air outlet and the valve opening; and an outer device outside of the shell of the respirator to control movement of the valve member, whereby when the valve member is closed, air will flow through the air inlet conduit and out of the at least one air outlet, but not out of the valve opening.

17. A method for controlling air flow within a respirator, the respirator comprising a shell that defines a breathable air zone for a user wearing the respirator, an air delivery conduit within the shell of the respirator, wherein the air delivery conduit is separable from the shell, the conduit comprising at least one air outlet for delivering breathable air to the user's facial area, a valve member positioned in a valve opening prior to the air outlet, an air inlet in fluid communication with the air delivery conduit and positioned upstream of both of the at least one air outlet and the valve opening, and an outer device outside of the shell to control movement of the valve member, the method comprising:

forcing air through the air delivery conduit; and rotating an outer device outside of the shell to manipulate the valve member and vary the air flow through the valve opening and the at least one air outlet, whereby when the valve member is closed, air will flow through the air inlet conduit and out of the at least one air outlet but not out of the valve opening.

* * * * *